US010689162B2

(12) United States Patent
Tameda et al.

(10) Patent No.: US 10,689,162 B2
(45) Date of Patent: Jun. 23, 2020

(54) BAG WITH ZIPPER TAPE

(71) Applicant: IDEMITSU UNITECH CO., LTD., Tokyo (JP)

(72) Inventors: Yusuke Tameda, Tokyo (JP); Ryo Katada, Tokyo (JP); Takumi Todaka, Chiba (JP)

(73) Assignee: IDEMITSU UNITECH CO., LTD., Tokyo (JP)

( * ) Notice: Subject to any disclaimer, the term of this patent is extended or adjusted under 35 U.S.C. 154(b) by 0 days.

(21) Appl. No.: 15/763,399

(22) PCT Filed: Sep. 23, 2016

(86) PCT No.: PCT/JP2016/077928
§ 371 (c)(1),
(2) Date: Mar. 26, 2018

(87) PCT Pub. No.: WO2017/051835
PCT Pub. Date: Mar. 30, 2017

(65) Prior Publication Data

US 2018/0257820 A1 Sep. 13, 2018

(30) Foreign Application Priority Data

Sep. 25, 2015 (JP) ..... 2015-188950

(51) Int. Cl.
*B65D 33/25* (2006.01)
*B65D 33/00* (2006.01)
*B65D 33/08* (2006.01)

(52) U.S. Cl.
CPC ..... *B65D 33/2566* (2013.01); *B65D 33/00* (2013.01); *B65D 33/007* (2013.01);
(Continued)

(58) Field of Classification Search
CPC .. B65D 33/2566; B65D 33/00; B65D 33/007; B65D 33/08; B65D 33/25; B65D 33/2508; B65D 33/2533
(Continued)

(56) References Cited

U.S. PATENT DOCUMENTS 5,931,582 A * 8/1999 Nichols ..... B65D 33/2541 24/DIG. 50
7,419,300 B2 * 9/2008 Pawloski ..... B65D 33/10 383/10
(Continued)

FOREIGN PATENT DOCUMENTS

JP 2000191053 A * 7/2000 ..... B65D 33/2541
JP 2002337891 A * 11/2002
(Continued)

OTHER PUBLICATIONS

Machine translation of JP-2000191053-A.*
(Continued)

*Primary Examiner* — Jes F Pascua
(74) *Attorney, Agent, or Firm* — Millen, White, Zelano & Branigan, PC; Ryan Pool

(57) ABSTRACT

A zipper-tape bag includes a bag body and tabs each provided to an outside of the bag body at a position closer to a housing space than a zipper tape. The bag body can be easily unsealed upon disengagement of a male portion and a female portion simply by pinching and pulling the tabs in mutually separating directions. The tabs are spaced away from an opening, which is formed after a top seal is cut off, in order that the content can be taken out or put in. The content can thus be put in and taken out without problems such as adhesion of the content to the hand and contamination of the content by touching the content by hand.

10 Claims, 28 Drawing Sheets

(52) U.S. Cl.
CPC ..... *B65D 33/08* (2013.01); *B65D 33/25* (2013.01); *B65D 33/2508* (2013.01); *B65D 33/2533* (2013.01)

(58) Field of Classification Search
USPC ..... 383/63, 65, 61.2
See application file for complete search history.

(56) References Cited

U.S. PATENT DOCUMENTS

| | | | | |
|---|---|---|---|---|
| 9,284,097 | B2 * | 3/2016 | Heckman | B65D 33/2508 |
| 9,790,002 | B2 * | 10/2017 | Tseng | B65D 33/007 |
| 10,011,403 | B1 * | 7/2018 | Kirsh | B65D 50/00 |
| 10,011,404 | B1 * | 7/2018 | Kirsh | B65D 50/00 |
| 2005/0271308 | A1 * | 12/2005 | Pawloski | B65D 33/2508 383/63 |
| 2005/0281487 | A1 | 12/2005 | Pawloski et al. | |
| 2007/0183692 | A1 * | 8/2007 | Pawloski | B65D 33/2508 383/61.2 |
| 2012/0074002 | A1 * | 3/2012 | Steele | B65D 81/3266 206/219 |
| 2014/0161374 | A1 * | 6/2014 | Septien Rojas | B65D 33/2508 383/63 |
| 2015/0367995 | A1 * | 12/2015 | Turvey | A44B 19/26 383/64 |
| 2016/0221723 | A1 * | 8/2016 | Tseng | B65D 33/007 |
| 2017/0190476 | A1 * | 7/2017 | Goto | B65D 33/25 |

FOREIGN PATENT DOCUMENTS

| | | | | |
|---|---|---|---|---|
| JP | 2010105698 | A | | 5/2010 |
| JP | 2011068385 | A | | 4/2011 |
| JP | 2011140326 | A | | 7/2011 |
| JP | 2012158378 | A | * | 8/2012 |
| JP | 2012250736 | A | | 12/2012 |
| JP | 2016098033 | A | * | 5/2016 |
| JP | 2016127886 | A | * | 7/2016 |
| WO | 2007143648 | A2 | | 12/2007 |
| WO | 2014052579 | A1 | | 4/2014 |
| WO | 2014066025 | A1 | | 5/2014 |

OTHER PUBLICATIONS

International Search Report for PCT/JP2016/077928 dated Nov. 1, 2016.
English Abstract of JP2011068385, Publication Date: Apr. 7, 2011.
English Abstract of JP2010105698, Publication Date: May 13, 2010.
English Abstract of JP2012250736, Publication Date: Dec. 20, 2012.
English Abstract of JP2011140326, Publication Date: Jul. 21, 2011.
English Translation of International Preliminary Report on Patentability dated Mar. 27, 2018.
English Translation of the Written Opinion of the International Search Authority for PCT/JP2016/077928 dated Jan. 11, 2016.
Search report in corresponding EP appl. 1648623.1 dated Feb. 25, 2019 (pp. 1-8).
Search report in corresponding EP appl. 16848623.1 dated Feb. 25, 2019 (pp. 1-8).

* cited by examiner

BAG WITH ZIPPER TAPE

TECHNICAL FIELD

The present invention relates to a zipper-tape bag.

BACKGROUND ART

Zipper-tape bags re-sealable after once unsealing bag bodies that house contents have recently come to be widely used. Some examples of the zipper-tape bags each include a tab for assisting unsealing (see, for instance, Patent Literature 1).

A zipper-tape bag of Patent Literature 1 includes a bag body defining therein a housing space for containing contents, and a zipper tape located at an inside of an edge of an opening formed when the bag body is unsealed, the zipper tape being engageable to reseal the opening. Further, an outside of the bag body is provided with an unsealing-assistive tab, which is provided to a first locking claw near the edge of the opening. Pulling the edge of the opening by holding the unsealing-assistive tab can disengage the zipper tape to unseal the bag body.

CITATION LIST

Patent Literatures

Patent Literature 1 JP 2011-140326 A

SUMMARY OF THE INVENTION

Problems to be Solved by the Invention

The present inventors have found out a new tab for unsealing through dedicated studies.

An object of the invention is to provide a zipper-tape bag with the new tab.

Means for Solving the Problems

According to an aspect of the invention, a zipper-tape bag includes: a bag body defining a housing space for containing a content; a zipper tape provided to an inside of the bag body, the inside of the bag body defining a first inner surface and a second inner surface facing the first surface, the zipper tape including: a first member including a first belt-shaped base bonded to the first inner surface of the bag body, and a first engaging portion provided to the first belt-shaped base; and a second member including a second belt-shaped base bonded to the second inner surface of the bag body, and a second engaging portion provided to the second belt-shaped base and engageable with the first engaging portion; and a tab provided to an outside of the bag body at a position closer to the housing space than a bonded position of each of the first belt-shaped base and the second belt-shaped base.

In the above aspect, the first engaging portion and the second engaging portion can be disengaged by holding the tab located closer to the housing space than the zipper tape and pulling the bag body, instead of holding a portion of the bag body near the edge of the opening. The content can thus be put in and taken out without problems such as adhesion of the content to the hand and contamination of the content by touching the content by hand.

Incidentally, the bag body may be in a variety of forms such as a bag produced by folding a single sheet of film, a bag produced by layering two sheets of film, and a gusset bag and a self-standing bag including two or more sheets of film to provide gussets at lateral sides thereof.

In the above aspect, the first belt-shaped base and the second belt-shaped base may each have opposite first and second ends in a width direction, the second end being located near the housing space with respect to the first end, and the zipper tape may require a larger disengaging force for disengaging the first engaging portion and the second engaging portion when portions of the first and second inner surfaces of the bag body respectively opposing the first ends of the first belt-shaped base and the second belt-shaped base are moved in mutually separating directions with the first engaging portion and the second engaging portion being engaged than when portions of the first and second inner surfaces of the bag body respectively opposing the second ends of the first belt-shaped base and the second belt-shaped base are moved in the mutually separating directions.

The above arrangement allows the first engaging portion and the second engaging portion to be disengaged by a smaller disengaging force when the portions of the first and second inner surfaces of the bag body opposing the second ends of the first belt-shaped base and the second belt-shaped base (the ends near the housing space) are moved in the mutually separating directions. In contrast, when the portions of the first and second inner surfaces near the opening opposite the housing space are moved in the mutually separating directions, a larger disengaging force becomes necessary for disengaging the first engaging portion and the second engaging portion. The bag body is thus unlikely to be unsealed from near the opening. Since the first engaging portion and the second engaging portion are unlikely to be disengaged from near the opening in a usual unsealing manner, unintentional unsealing from near the opening can be reduced.

In the above aspect, the first engaging portion may include a first locking claw projecting opposite the housing space, and a second locking claw projecting opposite the first locking claw, the second engaging portion may include a first engaging claw engageable with the first locking claw, and a second engaging claw engageable with the second locking claw, the first locking claw may have a first slant facing the first belt-shaped base, an angle θ between a tangent line from the first slant and a perpendicular line from the first belt-shaped base being smaller than 90 degrees, and the second locking claw may have a second slant facing the first belt-shaped base, an angle θ between a tangent line from the second slant and the perpendicular line from the first belt-shaped base being larger than 90 degrees.

In the above arrangement, the first engaging portion includes the first locking claw that projects like a hook in a cross-sectional view and the second locking claw that projects like a bulge in the cross-sectional view. Thus, in unsealing the bag body from near the opening opposite the housing space, first portions of the first belt-shaped base and the second belt-shaped base near the opening are separated from each other, causing the first locking claw with the hook-shaped cross section and the first engaging claw to come into strong engagement. Unintentional unsealing can thus be reduced simply by employing the predetermined claw shapes. In contrast, in unsealing the bag body by holding the tab, second portions of the first belt-shaped base and the second belt-shaped base near the housing space are separated from each other, causing the second locking claw with the bulge-shaped cross section and the second engaging claw to move in separating directions to be ready for disengagement. The disengagement can thus be easily achieved, further facilitating the unsealing operation by pinching the tab.

In the above aspect, one of the first belt-shaped base and the second belt-shaped base may be bonded to the bag body only at a portion near the housing space with respect to a position of the first engaging portion or the second engaging portion in the width direction.

In the above arrangement, the first belt-shaped base or the second belt-shaped base is bonded only at the portion near the housing space, or "one-side-released." In unsealing the bag body from near the opening, an unsealing force is applied along the first belt-shaped base and the second belt-shaped base in a direction for the belt-shaped bases to be sheared such that the one-side-released belt-shaped base is moved toward the housing space. The unsealing force in the direction for the belt-shaped bases to be sheared is thus applied in a direction for the first engaging portion and the second engaging portion to be strongly engaged. This increases a force necessary for disengaging the first engaging portion and the second engaging portion from near the opening, which results in reducing unintentional unsealing from near the opening. In contrast, in unsealing the bag body by pinching the tab, the second portions of the first belt-shaped base and the second belt-shaped base near the housing space are separated from each other without causing the first engaging portion and the second engaging portion to be strongly engaged, thus achieving easy unsealing.

According to another aspect of the invention, a zipper-tape bag includes: a bag body defining a housing space for containing a content; a first zipper tape provided to an inside of the bag body, the inside of the bag body defining a first inner surface and a second inner surface facing the first inner surface; a second zipper tape provided to the inside of the bag body in parallel with the first zipper tape, the second zipper tape being closer to the housing space than the first zipper tape, the first and second zipper tapes each including: a first member including a first belt-shaped base bonded to the first inner surface of the bag body, and a first engaging portion provided to the first belt-shaped base; and a second member including a second belt-shaped base bonded to the second inner surface of the bag body, and a second engaging portion provided to the second belt-shaped base and engageable with the first engaging portion; and a tab provided to an outside of the bag body at a position between the first zipper tape and the second zipper tape.

In the above aspect, the first engaging portion and the second engaging portion can be disengaged by holding the tab located between the first zipper tape and the second zipper tape and pulling the bag body, instead of holding a portion of the bag body near the edge of the opening. The content can thus be put in and taken out without problems such as adhesion of the content to the hand and contamination of the content by touching the content by hand. Further, the use of the plurality of zipper tapes improves the sealing performance.

In the above aspect, the first belt-shaped base and the second belt-shaped base of each of the first and second zipper tapes may each have opposite first and second ends in a width direction, the second end being located near the housing space with respect to the first end, the first zipper tape may require a larger disengaging force for disengaging the first engaging portion and the second engaging portion when portions of the first and second inner surfaces of the bag body respectively opposing the first ends of the first belt-shaped base and the second belt-shaped base are moved in mutually separating directions with the first engaging portion and the second engaging portion being engaged than when portions of the first and second inner surfaces of the bag body respectively opposing the second ends of the first belt-shaped base and the second belt-shaped base are moved in the mutually separating directions, and the second zipper tape may require a smaller disengaging force for disengaging the first engaging portion and the second engaging portion when portions of the first and second inner surfaces of the bag body respectively opposing the first ends of the first belt-shaped base and the second belt-shaped base are moved in mutually separating directions with the first engaging portion and the second engaging portion being engaged than when portions of the first and second inner surfaces of the bag body respectively opposing the second ends of the first belt-shaped base and the second belt-shaped base are moved in the mutually separating directions.

In the above arrangement, the first zipper tape, which is closer to the opening opposite to the housing space than the tab, requires a smaller disengaging force when the portions of the first and second inner surfaces of the bag body opposing the second ends of the belt-shaped bases (the ends near the housing space) are moved in mutually separating directions than when the portions of the first and second inner surfaces of the bag body opposing the first ends of the belt-shaped bases (the ends near the opening) are moved in the mutually separating directions. In contrast, the second zipper tape, which is located closer to the housing space opposite the opening than the tab, requires a larger disengaging force when the portions of the first and second inner surfaces of the bag body opposing the second ends of the belt-shaped bases (the ends near the housing space) are moved in the mutually separating directions. Thus, in unsealing the bag body from near the opening, the above arrangement allows the first zipper tape to be strongly engaged, increasing a force necessary for unsealing and, consequently, reducing unintentional unsealing. On the other hand, in unsealing the bag body by holding the tab, the above arrangement allows for weak engagement of the first and second zipper tapes, which are located on both sides of the tab in the width direction, thus achieving easy unsealing by a smaller force. Further, if an inner pressure of the bag body increases, the second zipper tape closer to the housing space would come into strong engagement, preventing leakage of the content due to unintentional unsealing.

In the above aspect, the first engaging portion of each of the first and second zipper tapes may include a first locking claw projecting opposite the housing space, and a second locking claw projecting opposite the first locking claw, the second engaging portion may include a first engaging claw engageable with the first locking claw, and a second engaging claw engageable with the second locking claw, the first locking claw of the first zipper tape may have a first slant facing the first belt-shaped base of the first zipper tape, an angle θ between a tangent line from the first slant and a perpendicular line from the first belt-shaped base of the first zipper tape being smaller than 90 degrees, the second locking claw of the first zipper tape may have a second slant facing the first belt-shaped base of the first zipper tape, an angle θ between a tangent line from the second slant and the perpendicular line from the first belt-shaped base of the first zipper tape being larger than 90 degrees, the first locking claw of the second zipper tape may have a third slant facing the first belt-shaped base of the second zipper tape, an angle θ between a tangent line from the third slant and a perpendicular line from the first belt-shaped base of the second zipper tape being larger than 90 degrees, and the second locking claw of the second zipper tape may have a fourth slant facing the first belt-shaped base of the second zipper tape, an angle θ between a tangent line from the fourth slant and the perpendicular line from the first belt-shaped base of the second zipper tape being smaller than 90 degrees.

In the above arrangement, the first engaging portion of the first zipper tape includes the first locking claw that projects like a hook in a cross-sectional view and the second locking claw that projects like a bulge in the cross sectional view. In contrast, the first engaging portion of the second zipper tape includes the first locking claw that projects like a bulge in the cross sectional view and the second locking claw that projects like a hook in a cross sectional view. Thus, in unsealing the bag body from near the opening opposite the housing space, the first portions of the first belt-shaped base and the second belt-shaped base near the opening are separated from each other, causing the first locking claw with the hook-shaped cross section and the first engaging claw to come into strong engagement. Unintentional unsealing can thus be reduced simply by employing the predetermined claw shapes. In contrast, in unsealing the bag by pinching the tab, the second portions of the first belt-shaped base and the second belt-shaped base of the first zipper tape near the housing space are separated from each other, while the first portions of the first belt-shaped base and the second belt-shaped base of the second zipper tape near the opening are separated from each other. This causes the second locking claw with the bulge-shaped cross section and the second engaging claw of the first zipper tape to move in the separating directions to be ready for disengagement, and causes the first locking claw with the bulge-shaped cross section and the first engaging claw of the second zipper tape to move in the separating directions to be ready for disengagement. The engagement can thus be easily achieved, further facilitating the unsealing operation by pinching the tab. Further, if the inner pressure of the bag body increases, the second portions of the first belt-shaped base and the second belt-shaped base of the second zipper tape near the housing space would be separated from each other, causing the second locking claw with the hook-shaped cross section and the second engaging claw to be strongly engaged. Unintentional unsealing and subsequent leakage of the content can thus be prevented simply by employing the predetermined claw shapes.

In the above aspect, one of the first belt-shaped base and the second belt-shaped base of the second zipper tape may be bonded to the bag body only at a portion opposite the housing space with respect to a position of the first engaging portion or the second engaging portion in the width direction.

In the above arrangement, the second zipper tape located closer to the housing space than the tab is "one-side-released", thus allowing for weak engagement to achieve easy unsealing by holding the tab. Further, if the inner pressure of the bag body increases, the inner pressure would be applied along the belt-shaped bases in a direction for the belt-shaped bases to be sheared, strengthening the engagement to prevent leakage of the content.

In the above aspect, one of the first belt-shaped base and the second belt-shaped base of the first zipper tape may be bonded to the bag body only at a portion near the housing space with respect to a position of the first engaging portion or the second engaging portion in the width direction.

In the above arrangement, the first zipper tape located closer to the opening opposite to the housing space than the tab is "one-side-released", thus allowing for weak engagement to achieve easy unsealing by holding the tab. In contrast, in unsealing the bag body by widening the opening, an unsealing force is applied along the first belt-shaped base and the second belt-shaped base in a direction for the belt-shaped bases to be sheared, strengthening the engagement of the first engaging portion and the second engaging portion and, consequently, increasing a force required for unsealing. Unintentional unsealing from near the opening can thus be reduced.

In the above aspect, one of the first engaging portion and the second engaging portion may include a neck area projecting from the first belt-shaped base or the second belt-shaped base, and the first belt-shaped base or the second belt-shaped base from which the neck area projects may include: a thickened area continuous in the width direction from a base end of the neck area, which projects from the first belt-shaped base or the second belt-shaped base, toward the tab; and a thinned area adjacent to the thickened area and thinner than the thickened area.

In unsealing the bag body by pinching the tab, the above arrangement allows the first belt-shaped base or the second belt-shaped base to be greatly bent around the boundary between the thickened area and the thinned area as the first belt-shaped base and the second belt-shaped base are moved in the separating directions. Thus, the first engaging portion and the second engaging portion are moved in a separating direction to be easily disengageable when the bag body is unsealed from near the tab, whereas the first engaging portion and the second engaging portion come into strong engagement to enhance the sealing performance when the bag body is unsealed from near the opening. The above arrangement thus achieves two conflicting characteristics such as reduction of unintentional unsealing and easy-open performance.

DESCRIPTION OF EMBODIMENT(S)

Figure 1:
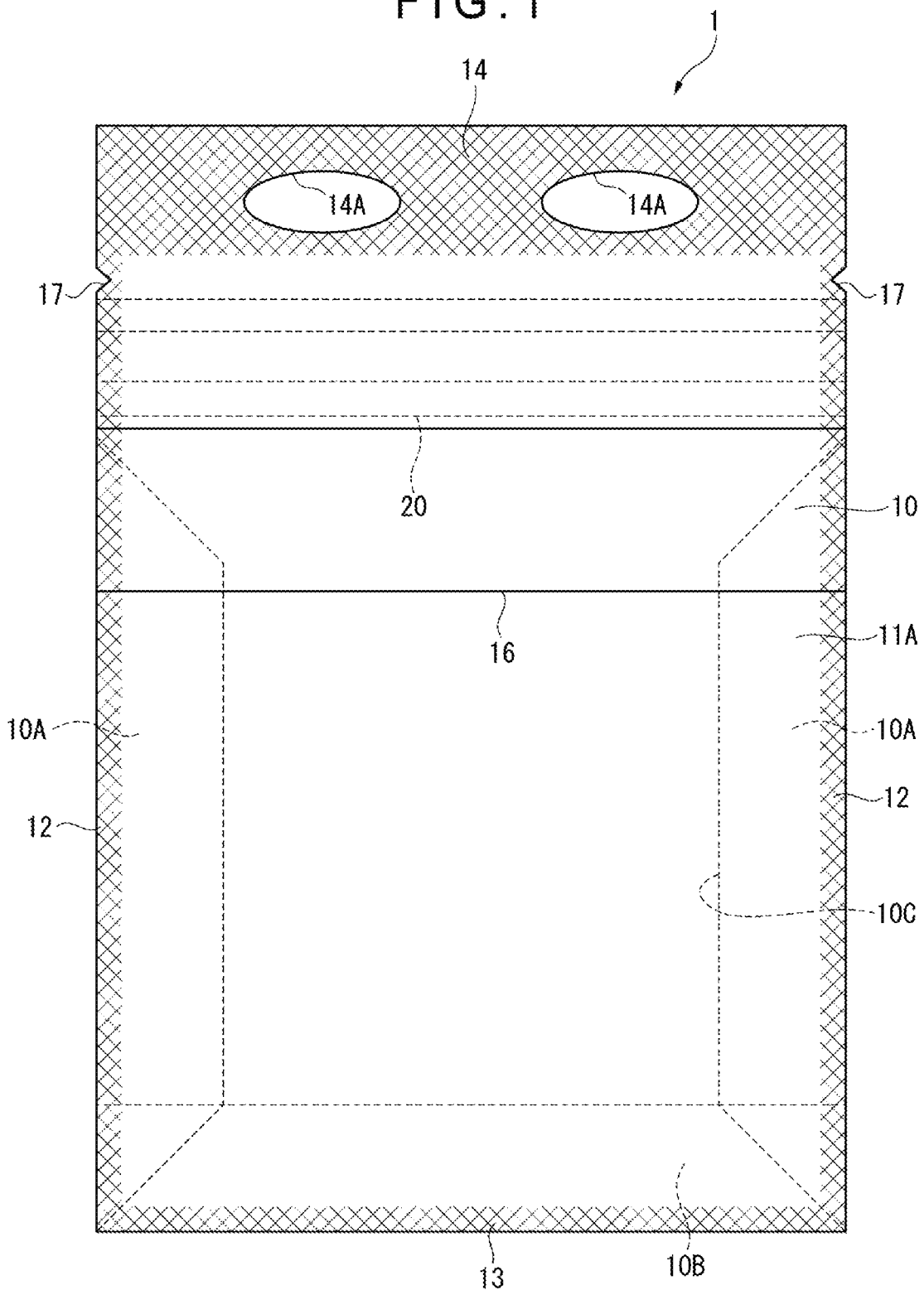
FIG. 1 is a front elevational view showing a zipper-tape bag according to a first exemplary embodiment of the invention.

Exemplary embodiments of the invention will be described below with reference to the attached drawings.

In the description of the exemplary embodiments, common reference numerals will be given to the same components to simplify or omit their explanations. It should be understood that the scope of the zipper tape and the zipper-tape bag of the invention is by no means limited by the disclosure in the exemplary embodiments below.

First Exemplary Embodiment

Figure 2:
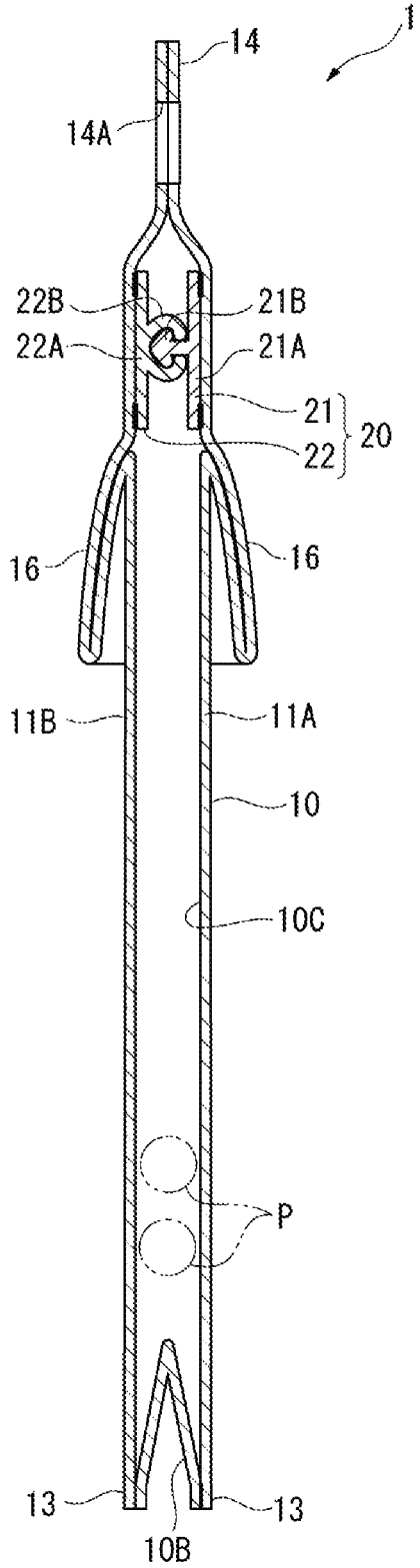
FIG. 2 is a cross sectional view of the zipper-tape bag.

FIGS. 1 and 2 show a zipper-tape bag according to a first exemplary embodiment.

Though the zipper-tape bag in the first exemplary embodiment is exemplarily provided in a form of a bag for packaging various articles including food, medicine, medical products, stationeries, and miscellaneous goods, the use of the zipper bag is not limited to packaging these examples of the articles.

Structure of Zipper-Tape Bag

FIG. 1 shows a front elevation of a zipper-tape bag 1. FIG. 2 shows a cross section of the zipper-tape bag 1. It should be noted that FIGS. 1 and 2 emphasize the zipper tape for the convenience of explanation.

As shown in FIG. 1, the zipper-tape bag 1 includes: a bag body 10 having a rectangular shape in a plan view and configured to contain a content; and a zipper tape 20 that is attached to an inner surface of the bag body 10 by bonding (e.g. heat-sealing).

Structure of Bag Body

The bag body 10 includes: layered films or base films 11A, 11B (only the base film 11A is shown in FIG. 1); and a pair of opposing lateral portions 10A provided at both ends of the layered base films 11A, 11B, the lateral portions 10A each being in a form of a gusset interfolded along a bend line. Further, the bag body 10 includes a bottom portion 10B at a bottom part of the layered films interfolded along a bend line.

The bag body 10 includes a pair of side seals 12 formed at layered portions of each of the base films 11A, 11B and the lateral portions 10A. A bottom seal 13 is formed at a layered portion of each of the base films 11A, 11B and the bottom portion 10B. A top seal 14 is formed at an end of the layered base films 11A, 11B orthogonal to the side seals 12 and opposite the bottom seal 13.

Further, a housing space 10C, in which a content P (see FIG. 2) is to be contained, is defined in the bag body 10 by the side seals 12, the bottom seal 13, and the top seal 14.

The zipper tape 20 is attached to the opposing base films 11A, 11B of the bag body 10.

It should be noted that flattened point seals (not shown) are formed at both longitudinal ends of the zipper tape 20 overlapped with the side seals 12 of the bag body 10.

The outside of the bag body 10 is provided with tongue-shaped tabs 16 formed by individually gathering the base films 11A, 11B, the tabs 16 being located closer to the housing space 10C, i.e. the bottom (a lower side in FIG. 1), than the zipper tape 20.

The locations of the tabs 16 are determined such that, for instance, the zipper tape 20 is located at base ends of the tabs 16 (i.e. adjacent positions), and are preferably beside the zipper tape 20.

Both ends of each of the tabs 16 in a longitudinal direction (a right-and-left direction in FIG. 1) are sealed at the side seals 12 and thus the tabs 16 are each in the shape of a pocket opening toward the bottom seal 13.

Two holes or grips 14A are provided to the top seal 14.

The grips 14A are holes that are oblong in a plan view and formed in the base films 11A, 11B. It should be noted that the shape of the holes are not necessarily oblong in a plan view but may alternatively be circular, rectangular, triangular or the like in a plan view. Further, the number of the holes is not limited but at least one is necessary to comfortably hold the bag. Further, the grip 14A may be provided in various forms. For instance, a separate string member may be attached in order to hold the bag. It should also be noted that the grip is not necessarily provided.

Further, a notch 17 is provided to the bag body 10 by cutting at a position between: an intersection of each of the ends of the zipper tape 20 in the longitudinal direction and a periphery of the corresponding one of the side seals 12 of the bag body 10; and an intersection of the top seal 14 and the periphery of the side seal 12.

The base films 11A, 11B may be single-layered or multi-layered films formed of, for instance, a thermoplastic resin such as (linear) low-density polyethylene (LLDPE), and polypropylene (PP). Examples of a surface base material usable for the multi-layered films include a biaxially-oriented polypropylene (Oriented Polypropylene: OPP), biaxially-oriented polyethylene terephthalate (OPET), biaxially-oriented nylon (ONy), and cast polypropylene (CPP). The multi-layered film may include an inorganic layer formed by depositing aluminum, laminating an aluminum foil, and the like in order to block light and permeation of gas (gas barrier).

Though any material for packaging bag is usable for the base films 11A, 11B, it is preferable that the thickness of the base films 11A, 11B is 10 μm or more and 200 μm or less. When the thickness is less than 10 μm, sealing strength and bag strength may sometimes be lowered. In contrast, the thickness exceeding 200 μm may sometimes make it difficult to unseal the bag.

Structure of Zipper Tape

FIG. 2 shows a cross sectional view of a relevant part of the zipper tape 20.

As shown in FIGS. 1 and 2, the zipper tape 20 includes a male member 21 (first member) and a female member 22 (second member) that are configured to be engaged with and disengaged from each other.

The male member 21 and the female member 22 are respectively bonded to opposing inner surfaces of the base films 11A, 11B through a suitable process such as heat-sealing and adhesion.

The male member 21 includes a male belt-shaped base 21A (first belt-shaped base), and a male portion 21B (first engaging portion) continuous with the male belt-shaped base 21A. The male portion 21B is formed along a longitudinal direction of the male belt-shaped base 21A (i.e. in a direction penetrating through FIG. 2).

The female member 22 includes a female belt-shaped base 22A (second belt-shaped base), and a female portion 22B (second engaging portion) projecting from the female belt-shaped base 22A and configured to be engaged with and disengaged from the male portion 21B. The female portion 22B is formed along a longitudinal direction of the female belt-shaped base 22A (i.e. in the direction penetrating through FIG. 2).

The zipper tape 20 is made of, for instance, a polyolefin resin. It should be noted that the zipper tape 20 may have a shape retention property (i.e. adapted to keep the shape thereof when being bent in a longitudinal direction).

The polyolefin resin is preferably a polyethylene resin such as a low-density polyethylene or a linear low-density polyethylene, and a polypropylene resin. Examples of the usable polypropylene resin include homo-polypropylene (H-PP), block polypropylene (B-PP), random polypropylene (RPP), and propylene-ethylene-butene-1-random ternary copolymer.

To provide the zipper-tape bag 1, a zipper-tape bag 1A (see FIG. 3) including the bottom seal 13 is manufactured, and the content P is put in through an input opening (not shown) provided to the zipper-tape bag 1A. The input opening is then sealed, thus providing the zipper-tape bag 1 containing the content P.

Manufacture of Zipper-Tape Bag

A process for manufacturing the zipper-tape bag before the content P is put in will be described below as a part of the process for manufacturing the zipper-tape bag 1 of the first exemplary embodiment. It should be noted that the zipper-tape bag can be manufactured in a variety of processes.

Figure 3:
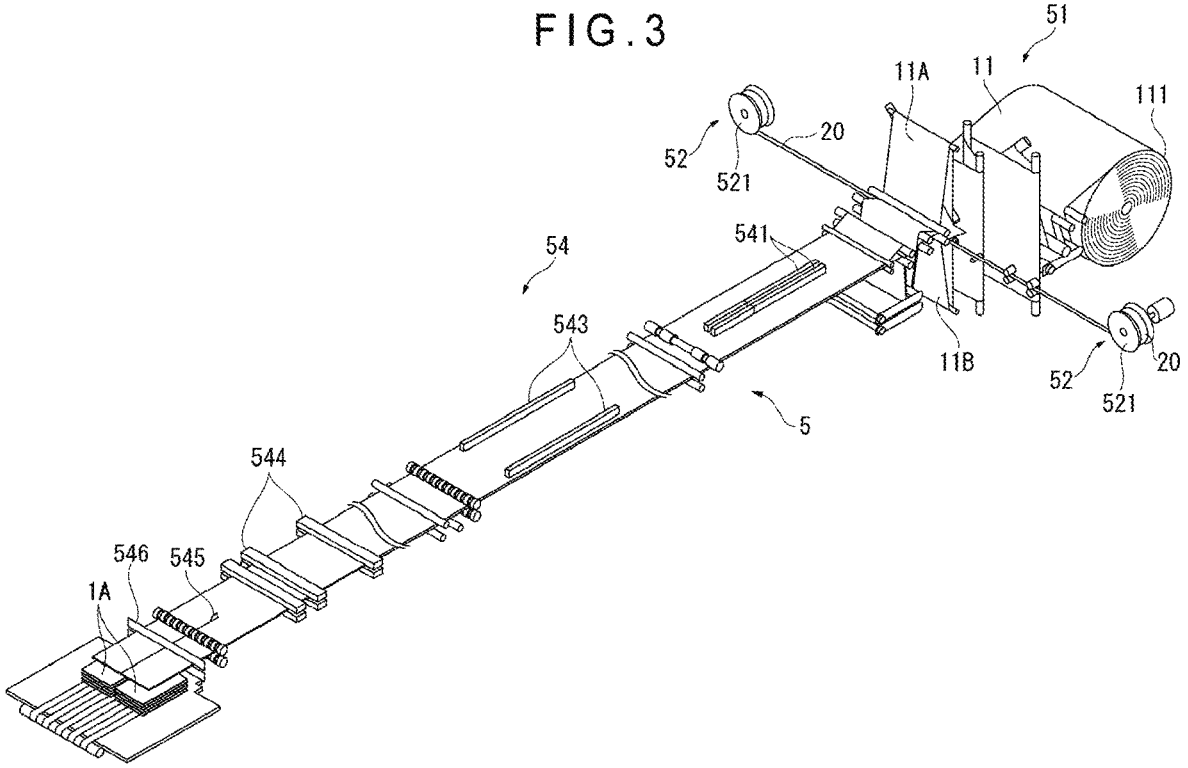
FIG. 3 schematically shows a structure of a manufacturing machine for manufacturing the zipper-tape bag.
Figure 4:
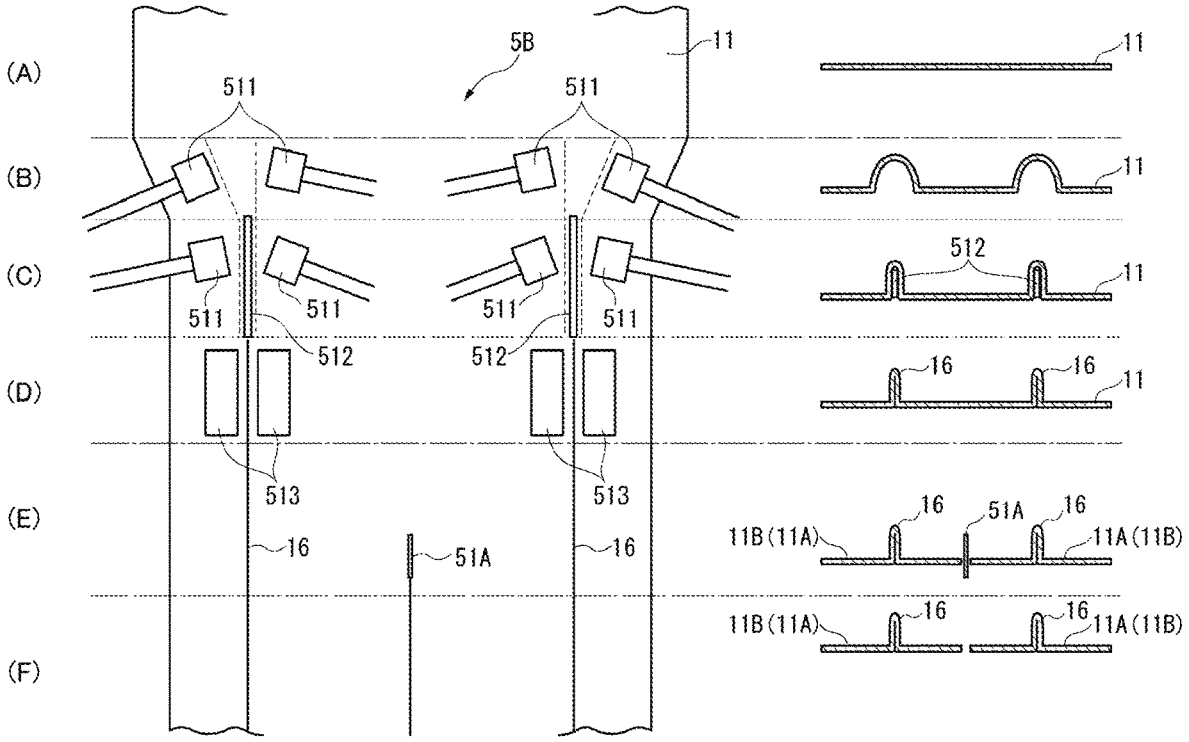
FIG. 4 illustrates a process for forming tabs by the manufacturing machine.

FIG. 3 schematically shows a structure of a manufacturing machine for manufacturing the zipper-tape bag. FIG. 4 illustrates a process for forming the tabs.

It should be noted that a left part of FIG. 4 is a plan view showing steps of the process for forming the tabs, and a right part is a cross sectional view corresponding to each of the steps. Specifically, FIG. 4 shows the following states: (A) a film is fed; (B) the film is being gathered; (C) the film is being formed into tabs; (D) the formation of the tabs is completed; (E) the film is being cut using a cutting blade; and (F) the film is cut into a pair of base films having the tabs.

Manufacturing Machine

A manufacturing machine 5 shown in FIG. 3, which has a basic arrangement of a so-called three-sided bag-making machine, is configured to respectively bond the male member 21 and the female member 22 onto the base films 11A, 11B to make the zipper-tape bag 1A.

The manufacturing machine 5 includes a film feeder 51 configured to feed the base films 11A, 11B, a pair of tape feeders 52 (tape-feeding mechanism) configured to feed the zipper tape 20 with the male portion 21B of the male member 21 being engaged with the female portion 22B of the female member 22, and a bag-manufacturing section 54 configured to respectively heat-seal the male member 21 and the female member 22 onto the base films 11A, 11B to make the bag body 10 and, consequently, make the zipper-tape bag 1A.

The film feeder 51 includes a removably attached film-winding roller 111 around which a film 11 is wound, and a cutting blade 51A (see FIG. 4) for cutting the film 11 into the base films 11A, 11B. The film feeder 51 is configured to feed the thus-obtained base films 11A, 11B forward.

The film feeder 51 also includes a tab former 51B as shown in FIG. 4. The tab former 51B includes: a pair of rollers 511 configured to gather the film 11; a guide plate 512 configured to fold the gathered film 11 to be doubled over a predetermined length at a predetermined position; and heat seal bars 513 configured to, for instance, heat-seal the doubled portion, which has been formed by partially folding the film 11 using the guide plate 512, to form the tongue-shaped tabs 16. The tabs 16 may be formed by various methods including welding using ultrasonic waves and bonding using an adhesive as well as heat-sealing.

It is not necessary to continuously feed the base films 11A, 11B at a constant speed but the base films 11A, 11B may be fed in any manner (e.g. intermittently feeding).

The tape feeders 52, each of which includes a removably attached tape-winding roller 521 around which the zipper tape 20 is wound, are configured to feed the zipper tape 20. The zipper tape 20 is fed toward the base films 11A, 11B from a lateral side of the base films 11A, 11B with respect to a feeding direction of the base films 11A, 11B and is bent at a predetermined position using a roller or the like in the feeding direction of the base films 11A, 11B into between the base films 11A, 11B.

It is not necessary to continuously feed the zipper tape 20 at a constant speed but the tape 20 may be fed in any manner (e.g. intermittently feeding).

The bag-manufacturing section 54 includes: a pair of seal bars 541 configured to respectively heat-seal the male member 21 and the female member 22 of the zipper tape 20 fed from the tape feeders 52 onto the base films 11A, 11B; a bottom former (not shown) configured to provide the bottom portion 10B to the layered base films 11A, 11B; a side former (not shown) configured to provide the lateral portions 10A to the layered base films 11A, 11B; and a first cut portion 545 and a second cut portion 546 configured to cut the base films 11A, 11B into the zipper-tape bag 1A.

The bottom former includes a bottom seal bar 543 configured to heat-seal the bottom portion 10B to each of the base films 11A, 11B to form the bottom seal 13.

The side former includes a side seal bar 544 configured to heat-seal the lateral portions 10A to each of the base films 11A, 11B to form the side seals 12.

It should be noted that the base films 11A, 11B are not necessarily heat-sealed to the male member 21 and the female member 22, but may be attached by various methods such as welding using ultrasonic waves and bonding using an adhesive.

A filling machine (not shown) for filling the formed zipper-tape bag 1A with the content P is provided downstream of the manufacturing machine 5.

Manufacturing Method of Zipper-Tape Bag

Next, a manufacturing method of manufacturing the zipper-tape bag 1A, which has not contained the content P for the zipper-tape bag 1, using the manufacturing machine 5 will be described below with reference to the attached drawings.

The manufacturing method of the zipper-tape bag 1A is conducted using, for instance, the manufacturing machine 5 for a three-sided bag-making process shown in FIG. 3. The manufacturing method includes: feeding the film 11 (film-feeding step); feeding the zipper tape 20 (tape-feeding step); heat-sealing the male member 21 and the female member 22 respectively to the base films 11A, 11B (attachment step); and forming the base films 11A, 11B into the zipper-tape bag 1A (bag-making step).

First, the film-winding roller 111 with the film 11 wound therearound is set on the film feeder 51.

Further, the female member 22 and the male member 21 are made by, for instance, extrusion molding. The female portion 22B of the female member 22 and the male portion 21B of the male member 21 are engaged with each other to form the zipper tape 20, which is wound around the tape-winding roller 521. The tape-winding roller 521 is then set on each of the tape feeders 52.

The film-feeding step includes a tab-forming step for providing the pair of tabs 16 to the film 11 fed from the film-winding roller 111 by the tab former 51B.

Specifically, the film 11 fed in the step (A) in FIG. 4 is gathered to provide a relaxed (wrinkled) portion at a predetermined position of the film 11 by the rollers 511 of the tab former 51B in the step (B) in FIG. 4. In the subsequent step (C) in FIG. 4, the relaxed portion of the film 11 is folded to be doubled over the predetermined length using the guide plate 512 of the tab former 51B. In the step (D) in FIG. 4, the doubled portion of the film 11 is then heat-sealed using the heat seal bars 513 of the tab former 51B to form the tongue-shaped tabs 16.

As shown in the step (E) in FIG. 4 subsequent to the above tab-forming step, the film 11 is halved in a direction intersecting the feeding direction of the film 11 using the cutting blade 51A. The base films 11A, 11B each having the tab 16 are thus formed by the cutting and fed downstream as shown in the step (F) in FIG. 4.

In the tape-feeding step, the zipper tape 20 unreeled from the tape-winding roller 521 is fed into between the base films 11A, 11B having been layered in two tiers and fed in the film-feeding step.

In the attachment step, both ends of the male member 21 in a width direction are bonded or heat-sealed onto one of the base films 11A, 11B using the seal bar 541, and both ends of the female member 22 in a width direction onto the other of the base films 11A, 11B.

In the bag-making step, the base films 11A, 11B having been attached with the male member 21 and the female member 22 in the attachment step are each provided with the bottom seal 13 using the bottom seal bar 543 to form the bottom portion 10B and, subsequently, provided with the side seals 12 using the side seal bar 544 to form the pair of lateral portions 10A. The gusset-shaped bag body 10 attached with the zipper tape 20 is then formed from the base films 11A, 11B. The zipper-tape bag 1A is thus manufactured. Subsequently, the content P is put in through an input opening (not shown) of the zipper-tape bag 1A, and the top seal 14 and the grips 14A are provided. The zipper-tape bag 1 containing the content P is thus manufactured.

Use of Zipper-Tape Bag

The use of the zipper-tape bag 1 will be described below.

To take out the content P from the zipper-tape bag 1 for the first time, a user tears the base films 11A, 11B from the notch 17 to cut off the top seal 14, thus forming an opening.

To take out the content P having been contained in the bag body 10 or put another content P in the bag body 10, the tabs 16 are individually pinched and pulled in mutually separating directions. The male portion 21B and the female portion 22B are then disengaged to unseal the bag body 10 by pulling the tabs 16, making the housing space 10C accessible so that the content P can be taken out or put in.

After the content P is taken out or put in, the male portion 21B and the female portion 22B are again engaged with each other to reseal the bag body 10.

Advantages of First Exemplary Embodiment

In the first exemplary embodiment, the outside of the bag body 10 is provided with the tabs 16, which are located closer to the housing space 10C than the zipper tape 20 as described above.

The bag body 10 can thus be easily unsealed upon disengagement of the male portion 21B and the female portion 22B simply by holding and pulling the tabs 16 in the mutually separating directions. The tabs 16 are spaced away from the opening, which is formed by cutting off the top seal 14 so that the content P can be taken out or put in. The content P can be put in and taken out without problems such as adhesion of the content P to the hand and contamination of the content P by touching the content P by hand.

The tabs 16 are each in the shape of a pocket opening toward the bottom seal 13, and both ends thereof in the longitudinal direction are sealed at the side seals 12.

To disengage the male portion 21B and the female portion 22B by holding and pulling the tabs 16 in the mutually separating directions, the hands can be inserted between these pocket-shaped tabs 16 and the outside of the bag body 10 to hold the tabs 16. The tabs 16 can thus be easily held, achieving easy unsealing.

Further, the film 11 is gathered and partially folded to be doubled, and the doubled portion is heat-sealed to form a tongue-shape.

Accordingly, the tab former 51B may be incorporated in a feeder for the film 11 in a typical bag-making machine to manufacture the zipper-tape bag 1 including the tabs 16. The use of the typical bag-making machine can contribute to easily manufacturing the zipper-tape bag 1 including the tabs 16.

Second Exemplary Embodiment

Next, a second exemplary embodiment of the invention will be described below with reference to the drawings.

The second exemplary embodiment is structurally the same as the first exemplary embodiment except that the zipper tape 20 including the male portion 21B and the female portion 22B in an asymmetric claw shape is used in place of the zipper tape 20 of the first exemplary embodiment.

Figure 5:
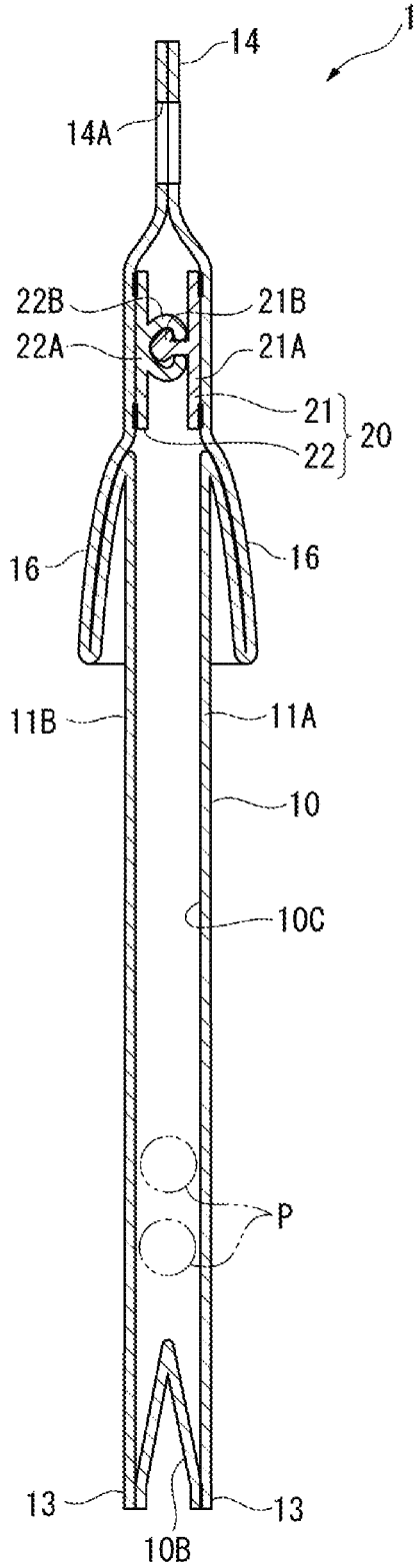
FIG. 5 is a cross sectional view of a zipper-tape bag according to a second exemplary embodiment of the invention.
Figure 6:
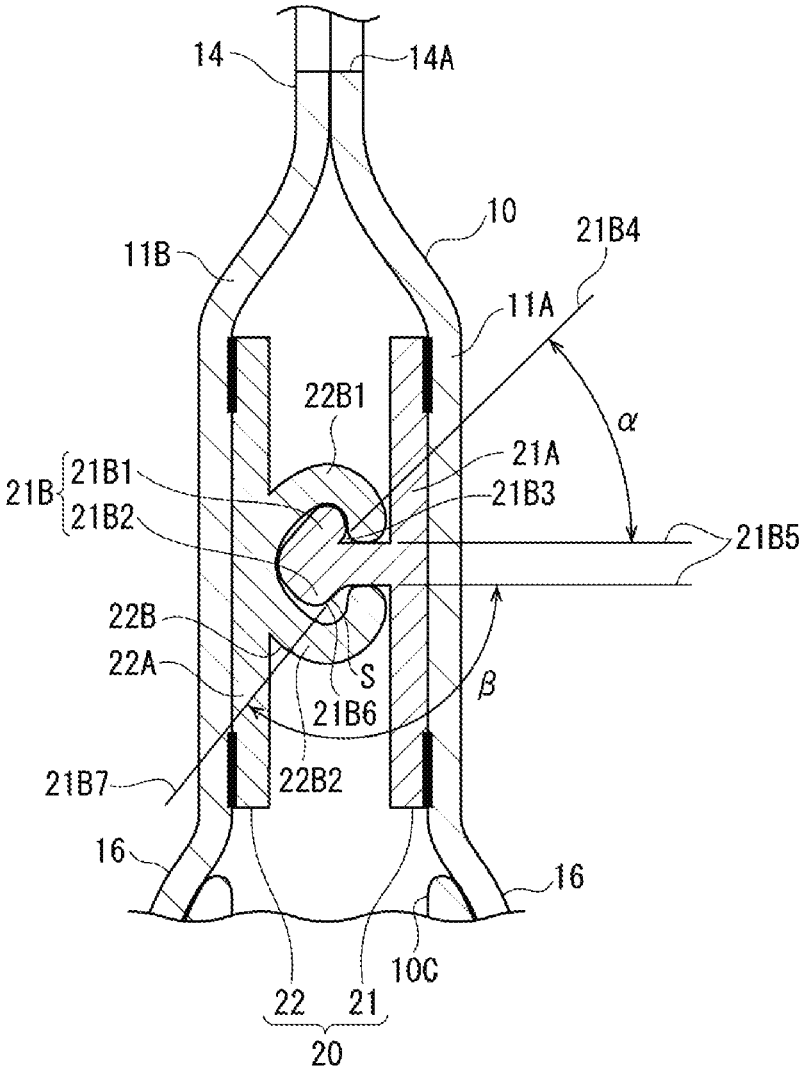
FIG. 6 is a cross sectional view of a relevant part of a zipper tape of the zipper-tape bag.

FIG. 5 is a cross sectional view of a zipper-tape bag according to the second exemplary embodiment. FIG. 6 is a cross sectional view of the zipper tape according to the second exemplary embodiment. It should be noted that FIGS. 5 and 6 emphasize the zipper tape for the convenience of explanation.

Further, in the description of the second exemplary embodiment, common reference numerals will be given to components identical or similar to those of the first exemplary embodiment to simplify or omit their explanations.

Structure of Zipper Tape

The male portion 21B of the zipper tape 20 includes a first male claw 21B1 (first locking claw) projecting opposite the housing space 10C, and a second male claw 21B2 (second locking claw) projecting opposite the first male claw 21B1.

The female portion 22B includes a first female claw 22B1 (first engaging claw) engageable with the first male claw 21B1 and a second female claw 22B2 (second engaging claw) engageable with the second male claw 21B2, the first female claw 22B1 and the second female claw 22B2 facing each other.

The first male claw 21B 1 has an opening-side slant 21B3 facing the male belt-shaped base 21A. The opening-side slant 21B3 has a hook-shaped cross section, where an angle α between a tangent line 21B4 from the opening-side slant 21B3 and a perpendicular line 21B5 from the male belt-shaped base 21A is smaller than 90 degrees.

In contrast, the second male claw 21B2 has a housing-side slant 21B6 facing the male belt-shaped base 21A. The housing-side slant 21B6 has a bulge-shaped cross section, where an angle β between a tangent line 21B7 from the housing-side slant 21B6 and a perpendicular line 21B5 from the male belt-shaped base 21A is larger than 90 degrees.

Incidentally, the opening-side slant 21B3 may be a flat surface or a curved surface, and the tangent line 21B4 means a tangent line from the flat surface in the former case or a tangent line passing through an inflection point S of the curved surface in the latter case. The same is applied to the tangent line 21B7.

Such an asymmetric claw shape of the zipper tape 20 of the zipper-tape bag 1 allows the second male claw 21B2 and the second female claw 22B2 to be disengaged by a smaller disengaging force when respective second ends of the male belt-shaped base 21A and the female belt-shaped base 22A in their width directions (the ends near the housing space 10C) are moved or pulled in mutually separating directions.

In contrast, when respective first ends of the male belt-shaped base 21A and the female belt-shaped base 22A in their width directions (the ends opposite the housing space 10C) are pulled in the mutually separating directions, a larger disengaging force is required and thus the bag body 10 is unlikely to be unsealed from near the opening.

Figure 7:
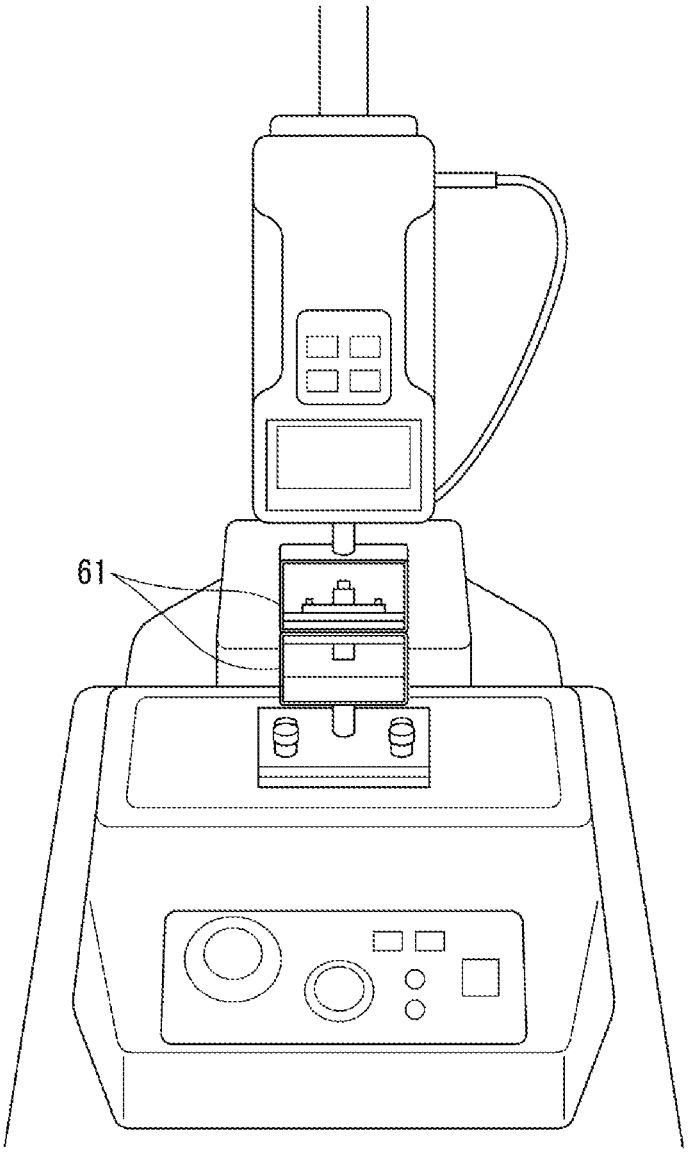
FIG. 7 shows a measuring device configured to measure a disengaging force for disengaging the zipper tape.
Figure 8:
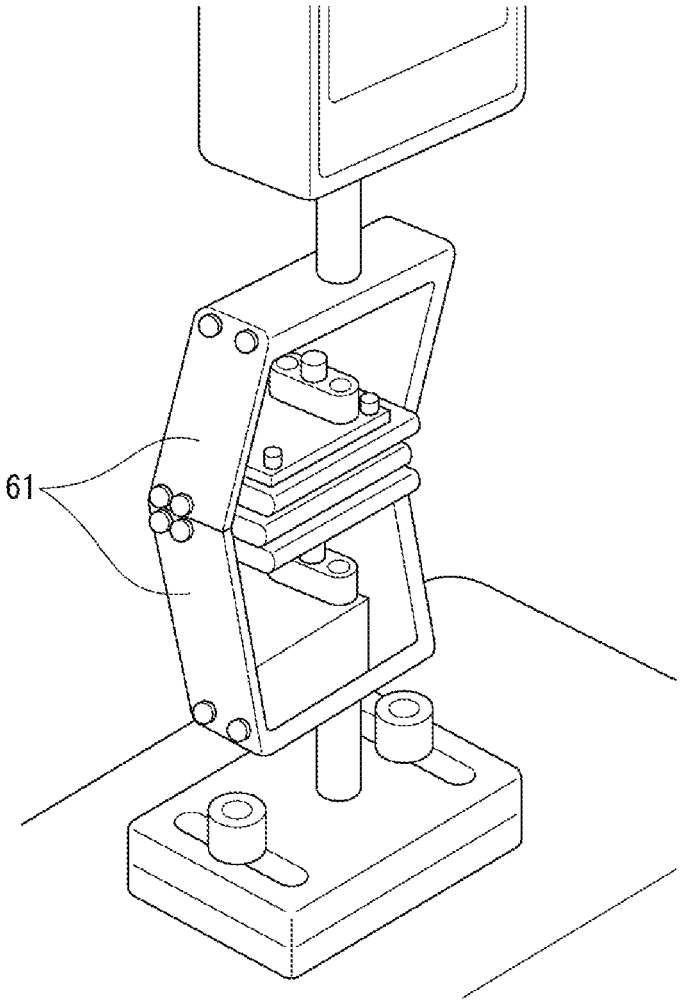
FIG. 8 shows a clamp of the measuring device.
Figure 9A:
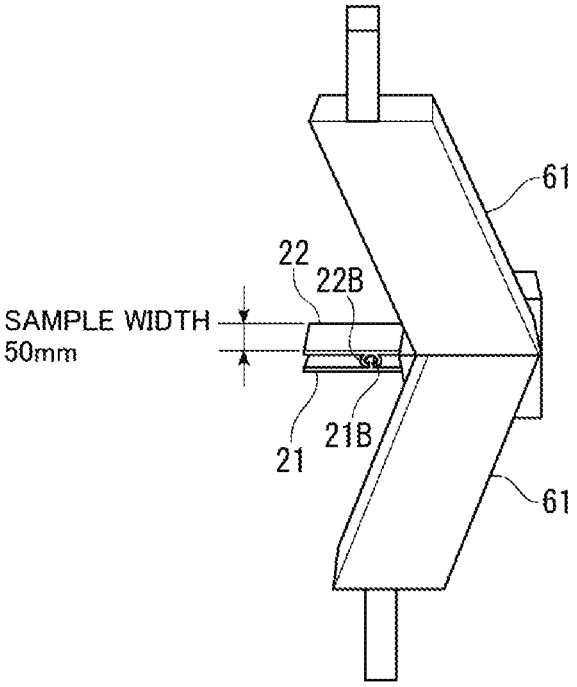
FIG. 9A shows a measuring method of measuring the disengaging force by the measuring device, where the zipper tape is set.
Figure 9B:
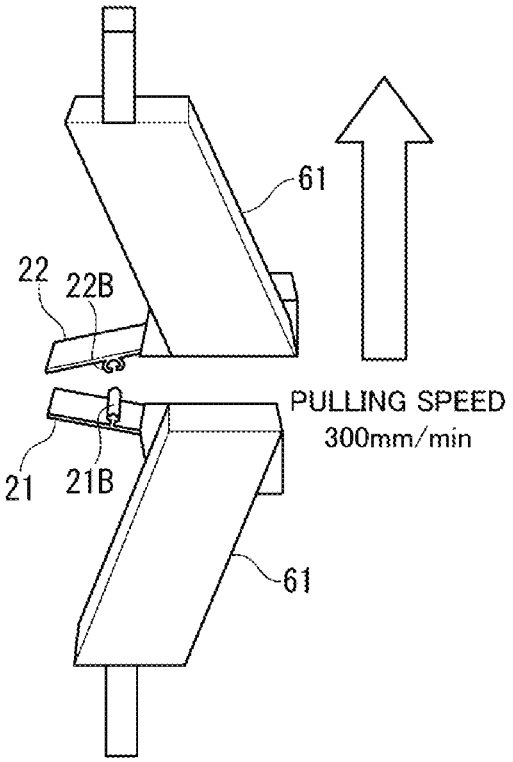
FIG. 9B shows the measuring method of measuring the disengaging force by the measuring device, where a pulling force is applied.

It should be noted that the disengaging force may be measured as shown in FIGS. 7 to 9.

Specifically, a digital force gauge (measuring gauge: manufactured by IMADA CO., LTD., DPZ-200N) is used.

For measurement, the male belt-shaped base 21A and the female belt-shaped base 22A being measured are cut into a 50-mm long test piece without changing their width. Respective first ends of the male belt-shaped base 21A and the female belt-shaped base 22A of the test piece in the width direction are individually held by a pair of clamps 61. The pair of clamps 61 are then moved in mutually separating directions at a speed of 300 mm/min to measure a maximum disengaging force necessary for disengaging the male portion 21B and the female portion 22B. Subsequently, respective second ends of the male belt-shaped base 21A and the female belt-shaped base 22A of the same test piece in the width directions are individually held by the pair of clamps 61 and a disengaging force is measured in the same manner.

Advantages of Second Exemplary Embodiment

In second exemplary embodiment, the first male claw 21B1 of the male portion 21B has the hook-shaped cross section, whereas the second male claw 21B2 has the bulge-shaped cross section.

Thus, in unsealing the bag from near the opening opposite the housing space 10C, the respective first ends of the male belt-shaped base 21A and the female belt-shaped base 22A in the width direction (the ends near the opening) are separated from each other, causing the first male claw 21B1 with the hook-shaped cross section and the first female claw 22B1 to come into strong engagement. Consequently, a larger disengaging force becomes necessary for disengagement of the male portion 21B and the female portion 22B. Unintentional unsealing can thus be reduced simply by employing the predetermined claw shapes.

In contrast, in unsealing the bag by pinching the tabs 16, the respective second ends of the male belt-shaped base 21A and the female belt-shaped base 22A in the width direction (the ends near the housing space 10C) are separated from each other, causing the second male claw 21B2 with the bulge-shaped cross section and the second female claw 22B2 to move in separating directions to be ready for disengagement. The male portion 21B and the female portion 22B thus become disengageable only by a smaller disengaging force. Consequently, the male portion 21B and the female portion 22B can be easily disengaged, further facilitating the unsealing operation by pinching the tabs 16.

Third Exemplary Embodiment

Next, a third exemplary embodiment of the invention will be described below with reference to the drawings.

The third exemplary embodiment is structurally the same as the second exemplary embodiment except that the zipper tape 20 is "one-side-released" when bonded to the base films 11A, 11B.

Figure 10:
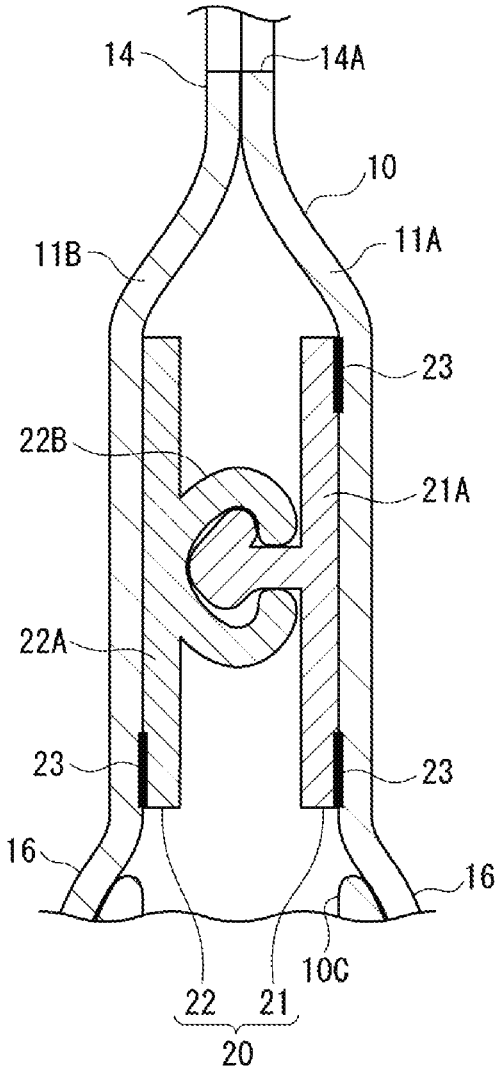
FIG. 10 is a cross sectional view of a zipper-tape bag according to a third exemplary embodiment of the invention.
Figure 11:
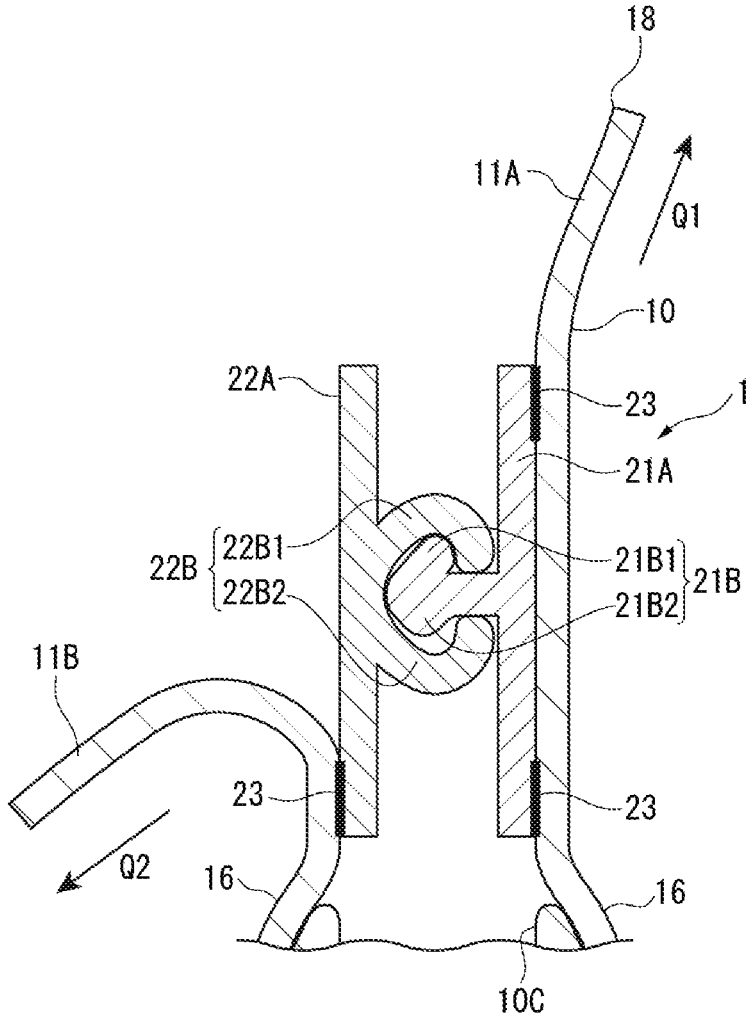
FIG. 11 is a cross sectional view of a relevant part showing how the bag is unsealed from near an opening.
Figure 12:
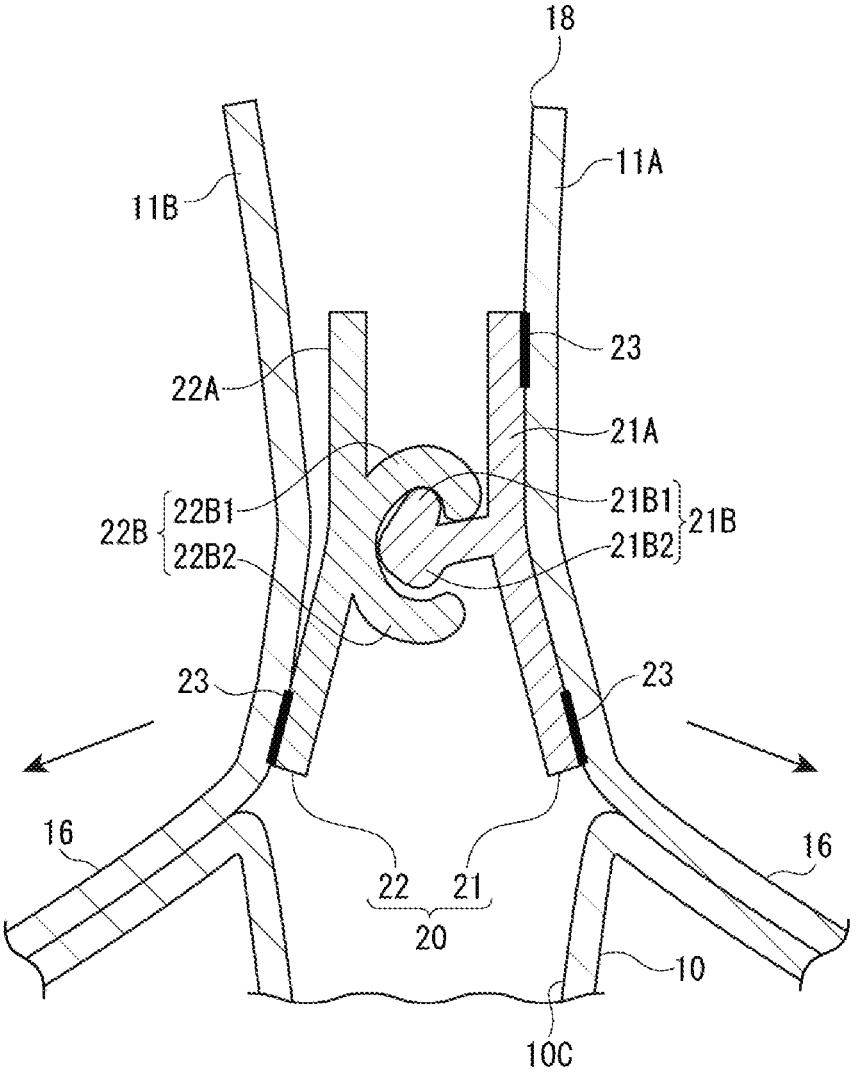
FIG. 12 is a cross sectional view of a relevant part showing how the bag is unsealed by pinching tabs.

FIG. 10 is a cross sectional view of a zipper-tape bag according to the third exemplary embodiment. FIG. 11 is a cross sectional view of the zipper tape and the surroundings thereof for showing how the bag is unsealed from near the opening. FIG. 12 is a cross sectional view of the zipper tape and the surroundings thereof for showing how the bag is unsealed by pinching the tabs. It should be noted that FIGS. 10 to 12 emphasize the zipper tape for the convenience of explanation.

In the third exemplary embodiment, one of the male belt-shaped base 21A and the female belt-shaped base 22A, for instance, the female belt-shaped base 22A, is "one-side-released." Specifically, the female belt-shaped base 22A, which has first portion and second portion defined in the width direction with respect to a position of the female portion 22B, is bonded to the base film 11B and provided with a seal portion 23 only at the second portion, which is located near the housing space 10C. Incidentally, both first and second portions of the male belt-shaped base 21A in the width direction are each bonded to the base film 11A and provided with a seal portion 23 in the same manner as in the second exemplary embodiment.

In the third exemplary embodiment, in unsealing the bag by pinching the edges of the opening 18 formed by cutting off the top seal 14 of the bag body 10, the male member 21 is pulled in a direction Q1 toward the opening 18, whereas the female member 22 is pulled in an opposite direction Q2 as shown in FIG. 11. A force in a shearing direction is thus applied to the male belt-shaped base 21A and the female belt-shaped base 22A, causing the first male claw 21B1 and the first female claw 22B1 to be strongly engaged. Consequently, a larger disengaging force becomes necessary for disengagement of the male portion 21B and the female portion 22B. Unintentional unsealing can thus be reduced simply by applying the one-side-release technique.

In contrast, in unsealing the bag by pinching and pulling the tabs 16 in the mutually separating directions, the second portions of the male belt-shaped base 21A and the female belt-shaped base 22A near the housing space 10C, or the bottom seal 13, are pulled in the mutually separating directions along with the base films 11A, 11B as shown in FIG. 12. This causes the second male claw 21B2 of the male portion 21B, which has the bulge-shaped cross section, and the second female claw 22B2 of the female portion 22B to move in a separating direction to be disengaged. Consequently, the male portion 21B and the female portion 22B can be easily disengaged by a smaller disengaging force, allowing for easy unsealing.

Advantages of Third Exemplary Embodiment

The third exemplary embodiment employs the one-side-release technique, where only the second portion of the female belt-shaped base 22A near the housing space 10C is bonded. The bag can be easily unsealed by a smaller disengaging force by holding the tabs 16, while the bag is unlikely to be unsealed from near the opening 18 in a usual manner. Unintentional unsealing of the bag can thus be reduced simply by applying the one-side-release technique.

It should be noted that the male member 21 may be one-side-released, although the female member 22 is one-side-released in the third exemplary embodiment.

Fourth Exemplary Embodiment

Next, a fourth exemplary embodiment of the invention will be described below with reference to the drawings.

The fourth exemplary embodiment is structurally the same as the first exemplary embodiment except that two zipper tapes 20 are arranged side by side, and the tabs 16 are provided between the zipper tapes 20.

Figure 13:
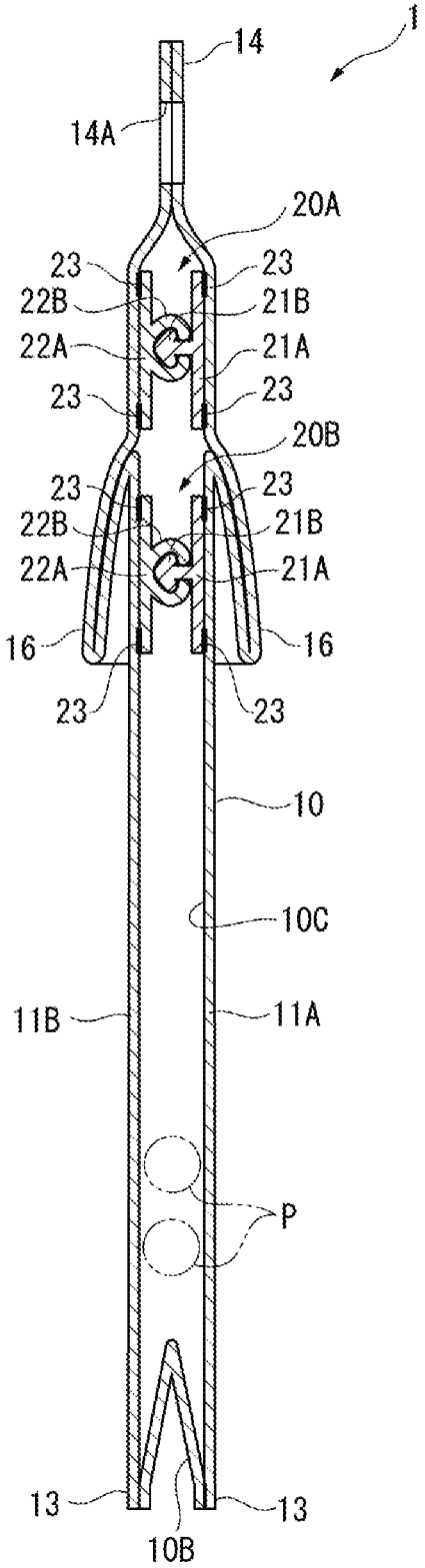
FIG. 13 is a cross sectional view of a zipper-tape bag according to a fourth exemplary embodiment of the invention.
Figure 14:
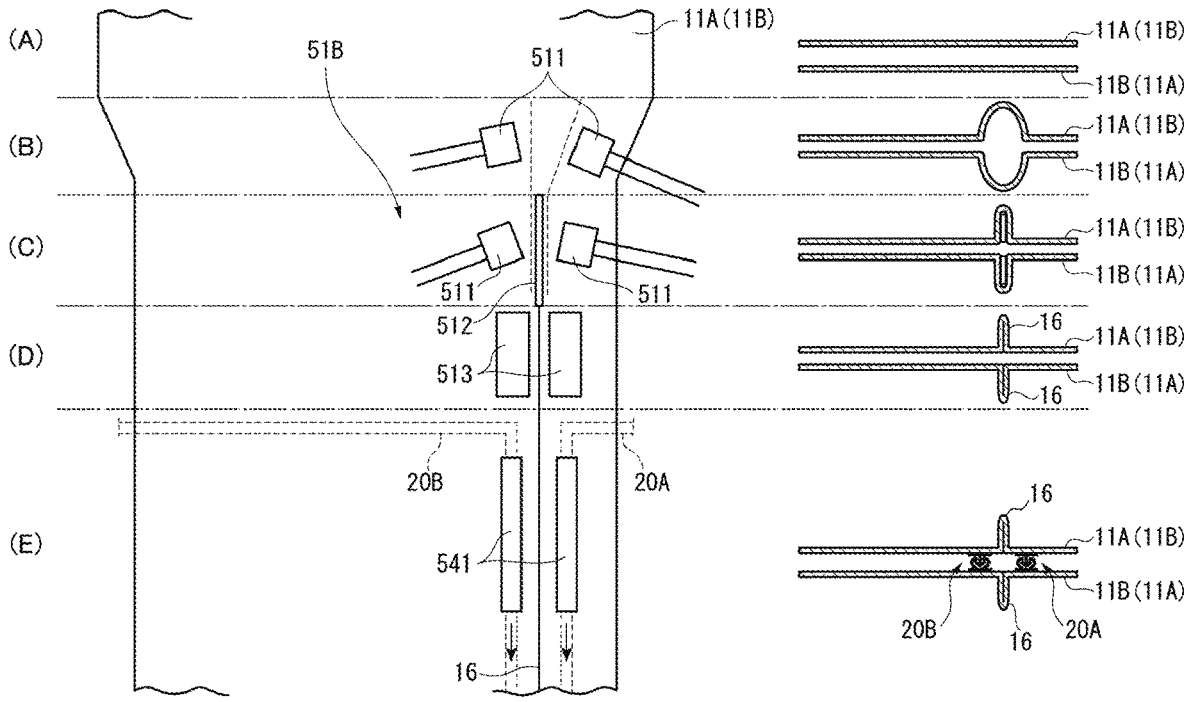
FIG. 14 illustrates a process for forming tabs by a manufacturing machine according to the fourth exemplary embodiment.

FIG. 13 is a cross sectional view of a zipper-tape bag according to the fourth exemplary embodiment. FIG. 14 illustrates a process for forming the tabs by the manufacturing machine. It should be noted that FIG. 13 emphasizes the zipper tape for the convenience of explanation.

The zipper-tape bag 1 according to the fourth exemplary embodiment includes the zipper tapes 20 that are provided side by side on opposing inner surfaces of the bag body 10 as shown in FIG. 13. Incidentally, the zipper tapes 20 include a first zipper tape 20A (corresponding to that of the first exemplary embodiment) located near the opening 18 and a second zipper tape 20B located near the housing space 10C. The tabs 16 are provided to the outside of the bag body 10 between the first and second zipper tapes 20A, 20B.

To provide the tabs 16 between the first and second zipper tapes 20A, 20B, for instance, a three-sided bag-making machine that includes the film feeder 51 including the tab former 51B as shown in FIG. 14 is used.

The film feeder 51 is configured to cut the film 11 fed from the film-winding roller 111 and provide the thus-obtained base films 11A, 11B with the tabs 16. Specifically, each of the base films 11A, 11B is gathered to the guide plate 512 using the rollers 511 of the tab former 51B, and portions of the base films 11A, 11B folded to be doubled using the guide plate 512 are heat-sealed using the heat seal bars 513 to form the tabs 16.

Subsequently, the first and second zipper tapes 20A, 20B fed from the tape feeders 52 are individually fed into between the base films 11A, 11B, positioned on both sides of the tabs 16 in the feeding direction of the base films 11A, 11B, and heat-sealed using the seal bar 541 of the bag-manufacturing section 54.

Further, after being provided with the top seal 14 using a top seal bar and, subsequently, provided with the side seals 12 using the side seal bar 544 to form the pair of lateral portions 10A, the base films 11A, 11B are formed into the bag body 10 in the form of a gusset attached with the first and second zipper tapes 20A, 20B. The zipper-tape bag 1A is thus manufactured.

Advantages of Fourth Exemplary Embodiment

In the fourth exemplary embodiment, the tabs 16 are provided between the two first and second zipper tapes 20A, 20B.

Such a plurality of zipper tapes, i.e. the first and second zipper tapes 20A, 20B, can improve the sealing performance.

Fifth Exemplary Embodiment

Next, a fifth exemplary embodiment of the invention will be described below with reference to the drawings.

The fifth exemplary embodiment is structurally the same as the third exemplary embodiment except that the zipper tape 20 of the third exemplary embodiment is modified such that a thickened portion is provided to the male belt-shaped base 21A at a base end of the male portion.

Figure 15:
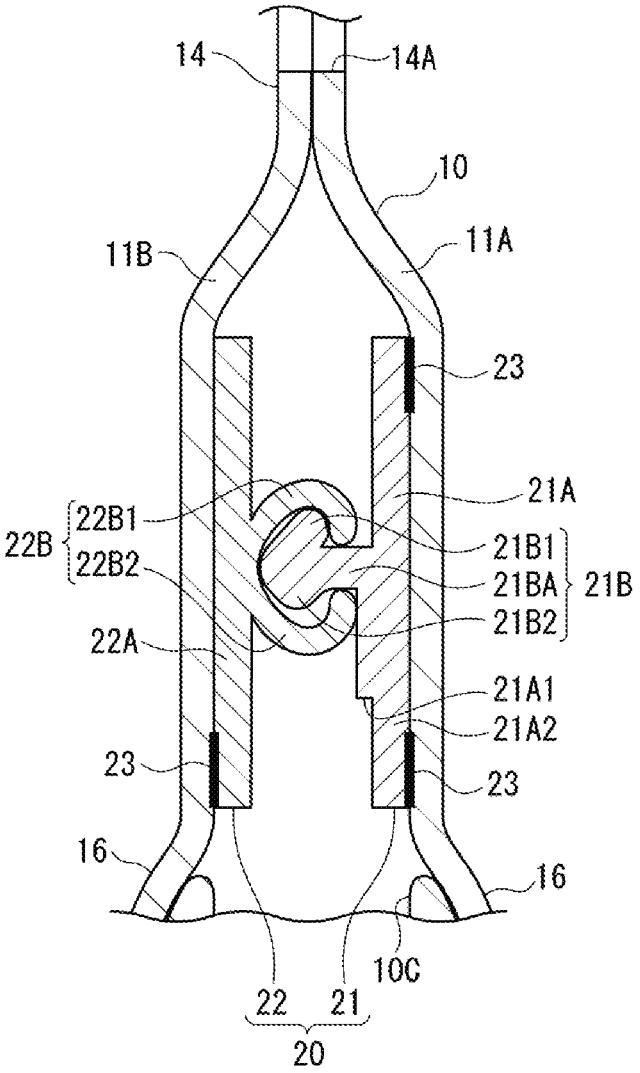
FIG. 15 is a cross sectional view of a zipper-tape bag according to a fifth exemplary embodiment of the invention.
Figure 16:
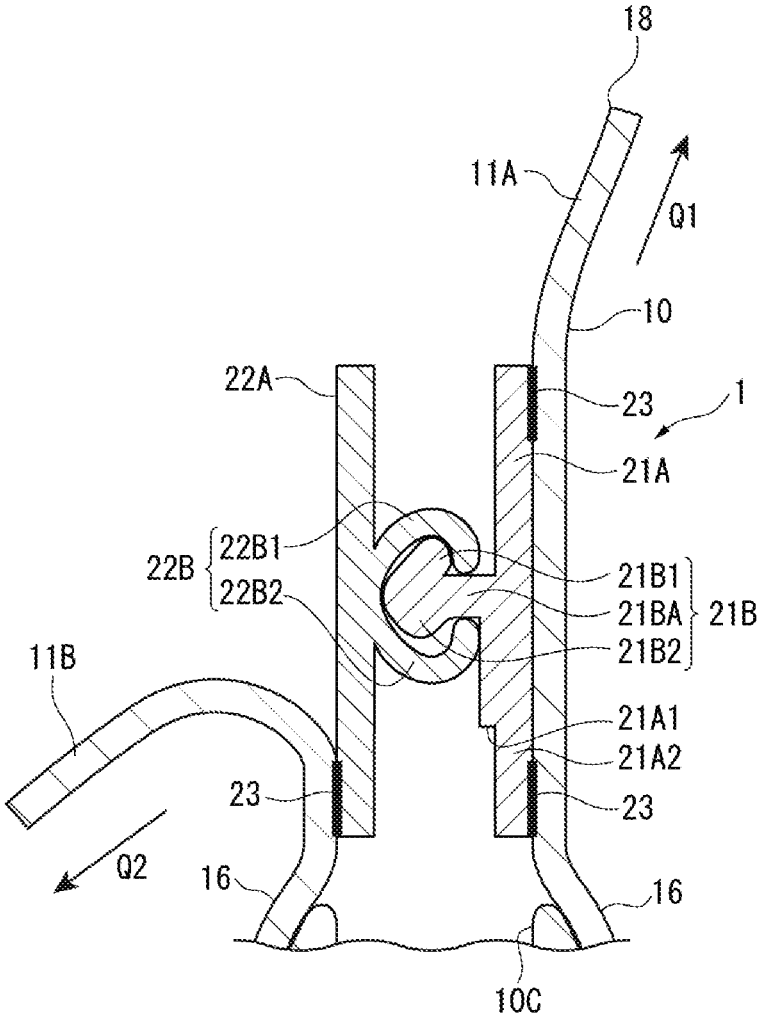
FIG. 16 is a cross sectional view of a relevant part showing how the bag is unsealed from near an opening.
Figure 17:
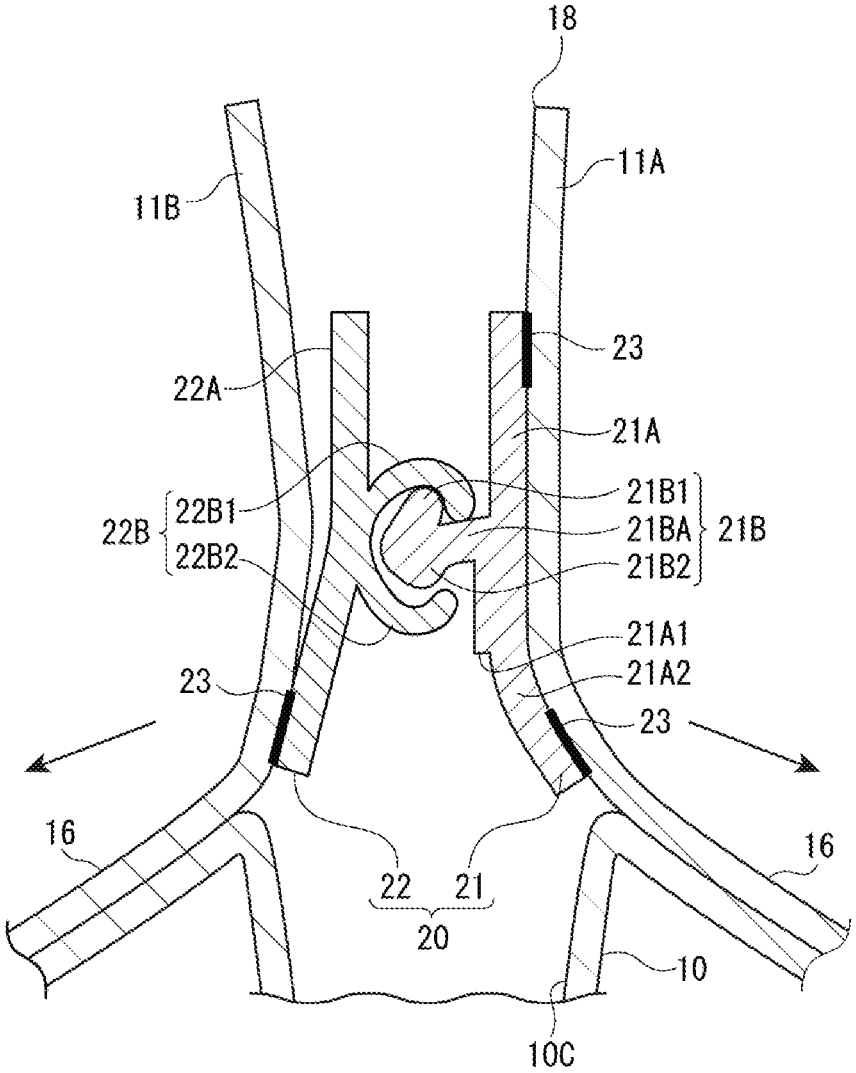
FIG. 17 is a cross sectional view of a relevant part showing how the bag is unsealed by pinching the tabs.

FIG. 15 is a cross sectional view of a zipper-tape bag according to the fifth exemplary embodiment. FIG. 16 is a cross sectional view of the zipper tape and the surroundings thereof for showing how the bag is unsealed from near the opening. FIG. 17 is a cross sectional view of the zipper tape and the surroundings thereof for showing how the bag is unsealed by pinching the tabs. It should be noted that FIGS. 15 to 17 emphasize the zipper tape for the convenience of explanation.

In the fifth exemplary embodiment, the male portion 21B includes a neck area 21BA projecting like a wall from the male belt-shaped base 21A and extending along a longitudinal direction of the male belt-shaped base 21A.

The neck area 21BA is provided with a first male claw 21B1 with a hook-shaped cross section projecting in the width direction of the male belt-shaped base 21A (opposite the housing space 10C) and extending along the longitudinal direction toward the first portion, and a second male claw 21B2 with a bulge-shaped cross section projecting in the width direction (toward the housing space 10C) along the longitudinal direction toward the second portion of the male belt-shaped base 21A.

Further, the male belt-shaped base 21A includes a thickened area 21A1 continuous from a base end of the neck area 21BA, which projects from the male belt-shaped base 21A, toward a projecting side of the second male claw 21B2. As a result, a portion of the male belt-shaped base 21A other than the thickened area 21A1 is defined as a thinned area 21A2 thinner than the thickened area 21A1, forming a step between the adjacent thickened area 21A1 and thinned area 21A2.

In the fifth exemplary embodiment, in unsealing the bag by pinching the edges of the opening 18 formed by cutting off the top seal 14 of the bag body 10, the male member 21 is pulled in the direction Q1 toward the opening 18, whereas the female member 22 is pulled in the opposite direction Q2 as shown in FIG. 16.

A force in a shearing direction is thus applied to the male belt-shaped base 21A and the female belt-shaped base 22A, causing the first male claw 21B1 and the first female claw 22B1 to be strongly engaged. Consequently, a larger disengaging force becomes necessary for disengagement of the male portion 21B and the female portion 22B. Unintentional unsealing can thus be reduced simply by employing the one-side-bonding.

In contrast, in unsealing the bag by pinching and pulling the tabs 16 in the mutually separating directions, the second portions of the male belt-shaped base 21A and the female belt-shaped base 22A near the housing space 10C, or the bottom seal 13, are pulled in the mutually separating directions along with the base films 11A, 11B as shown in FIG. 17. Such an unsealing force causes the male belt-shaped base 21A to be greatly bent around the boundary between the thickened area 21A1 and the thinned area 21A2 without greatly bending the neck area 21BA and the surroundings thereof.

This causes the second male claw 21B2 of the male portion 21B, which has the bulge-shaped cross section, and the second female claw 22B2 of the female portion 22B to move in a separating direction to be disengaged. Consequently, the male portion 21B and the female portion 22B can be easily disengaged by a smaller disengaging force, allowing for easy unsealing.

Advantages of Fifth Exemplary Embodiment

In the fifth exemplary embodiment, the movement of the male belt-shaped base 21A and the female belt-shaped base 22A in the separating directions causes the male belt-shaped base 21A to be greatly bent around the boundary between the thickened area 21A1 and the thinned area 21A2.

Although engagement between the first male claw 21B1 of the male portion 21B and the first female claw 22B1 of the female portion 22B is strengthened to improve the sealing performance, the zipper tape 20 can be easily disengaged from the projecting side of the second male claw 21B2 by holding and pulling the tabs 16. The fifth exemplary embodiment thus enables easy unsealing and, further, prevents unintentional unsealing.

Modifications

Preferable configurations for practicing the invention and the like have been disclosed above, however, the invention is not limited thereto. In other words, while the invention has been particularly explained and illustrated mainly in relation to specific exemplary embodiments, a person skilled in the art could make various modifications in terms of materials, quantity or other particulars to the above described exemplary embodiments without deviating from the technical idea or any object of the invention.

Accordingly, the description that limits the materials, the layer structure and the like is only an example to make the invention easily understood, but is not intended to limit the invention, so that the invention includes the description using a name of component without a part of or all of the limitation on the shape and the material etc.

For instance, the first exemplary embodiment employs the male portion 21B as the locking portion and the female portion 22B as the engaging portion, but the female portion 22B may be the locking portion and the male portion 21B may be the engaging portion.

Further, with regard to the locking portion and the engaging portion, the male portion 21B may have various shapes in addition to a symmetric claw shape as in the first exemplary embodiment or an asymmetric claw shape as in the second exemplary embodiment.

Figure 18:
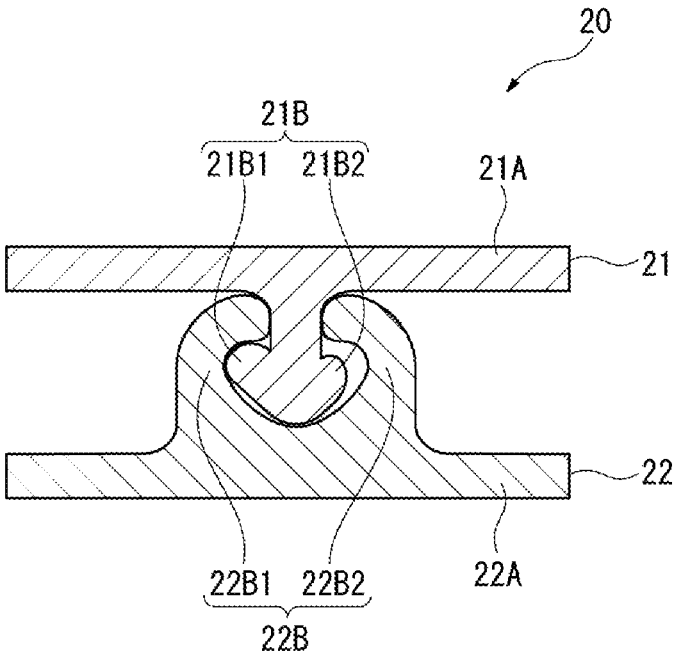
FIG. 18 is a cross sectional view of a zipper tape according to another exemplary embodiment of the invention.

For instance, as shown in FIG. 18, the first male claw 21B1 (first locking claw) of the male portion 21B may project longer than the second male claw 21B2 (second locking claw) to enhance the engagement between the first male claw 21B1 and the first female claw 22B1 (first engaging claw). In this case, the bag can be easily unsealed by holding the tabs 16, while it is unlikely to be unsealed from near the opening 18.

Alternatively, the second male claw 21B2 may be omitted (a single-claw arrangement).

Figure 19:
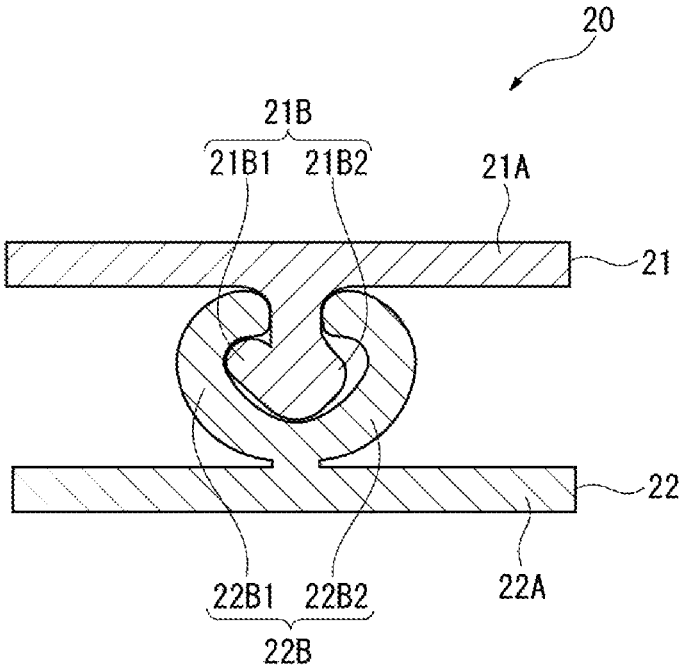
FIG. 19 is a cross sectional view of a zipper tape according to still another exemplary embodiment of the invention.

With regard to the female portion 22B, for instance, as shown in FIG. 19, the first female claw 22B1 and the second female claw 22B2 may be branched.

Figure 20:
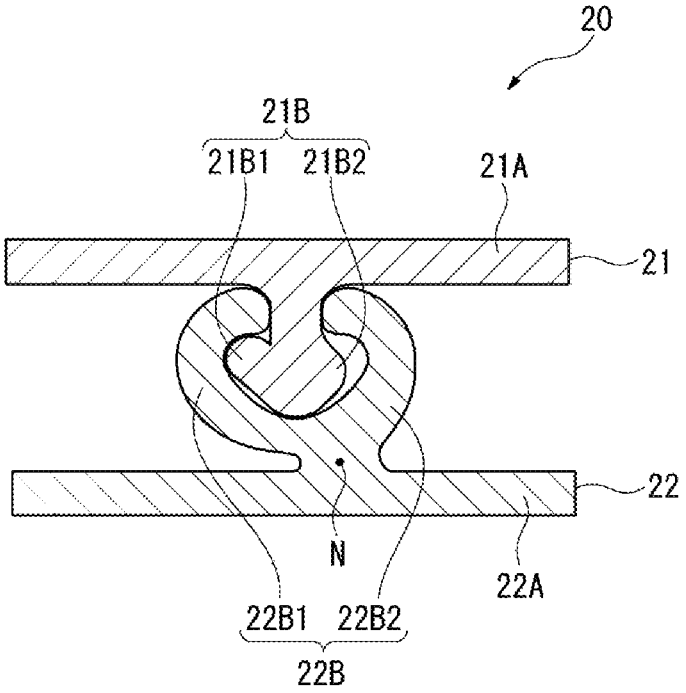
FIG. 20 is a cross sectional view of a zipper tape according to further another exemplary embodiment of the invention.

With regard to the female portion 22B, for instance, as shown in FIG. 20, a position where the first female claw 22B1 and the second female claw 22B2 project from the female belt-shaped base 22A may be displaced toward the housing space 10C with respect to the engagement position. In unsealing the bag from near the opening 18 when the male portion 21B and the female portion 22B are engaged, the above arrangement allows the first female claw 22B1, which is engaged with the first male claw 21B1, to be pulled along with the first male claw 21B1 to rotate around a supporting point N, enhancing the engagement therebetween. A larger disengaging force thus becomes necessary to unseal the bag, which results in preventing unintentional unsealing from near the opening 18.

Figure 21:
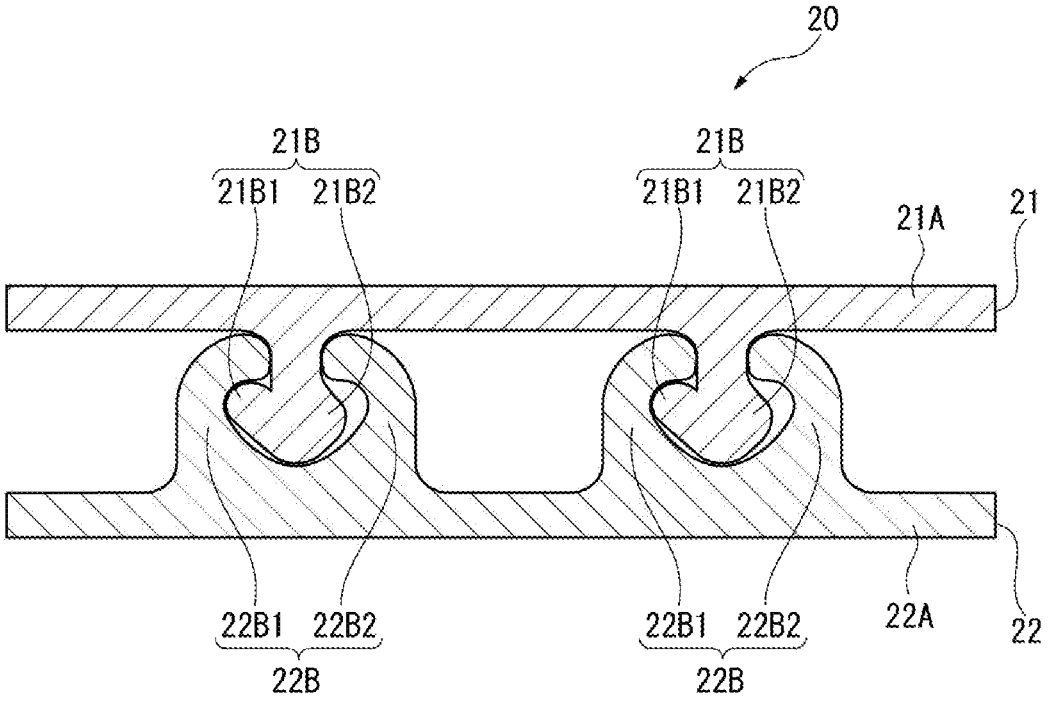
FIG. 21 is a cross sectional view of a zipper tape according to still further another exemplary embodiment of the invention.

Further, for instance, as shown in FIG. 21, the zipper tape 20 may include a plurality of pairs of male portions 21B and female portions 22B.

Figure 22:
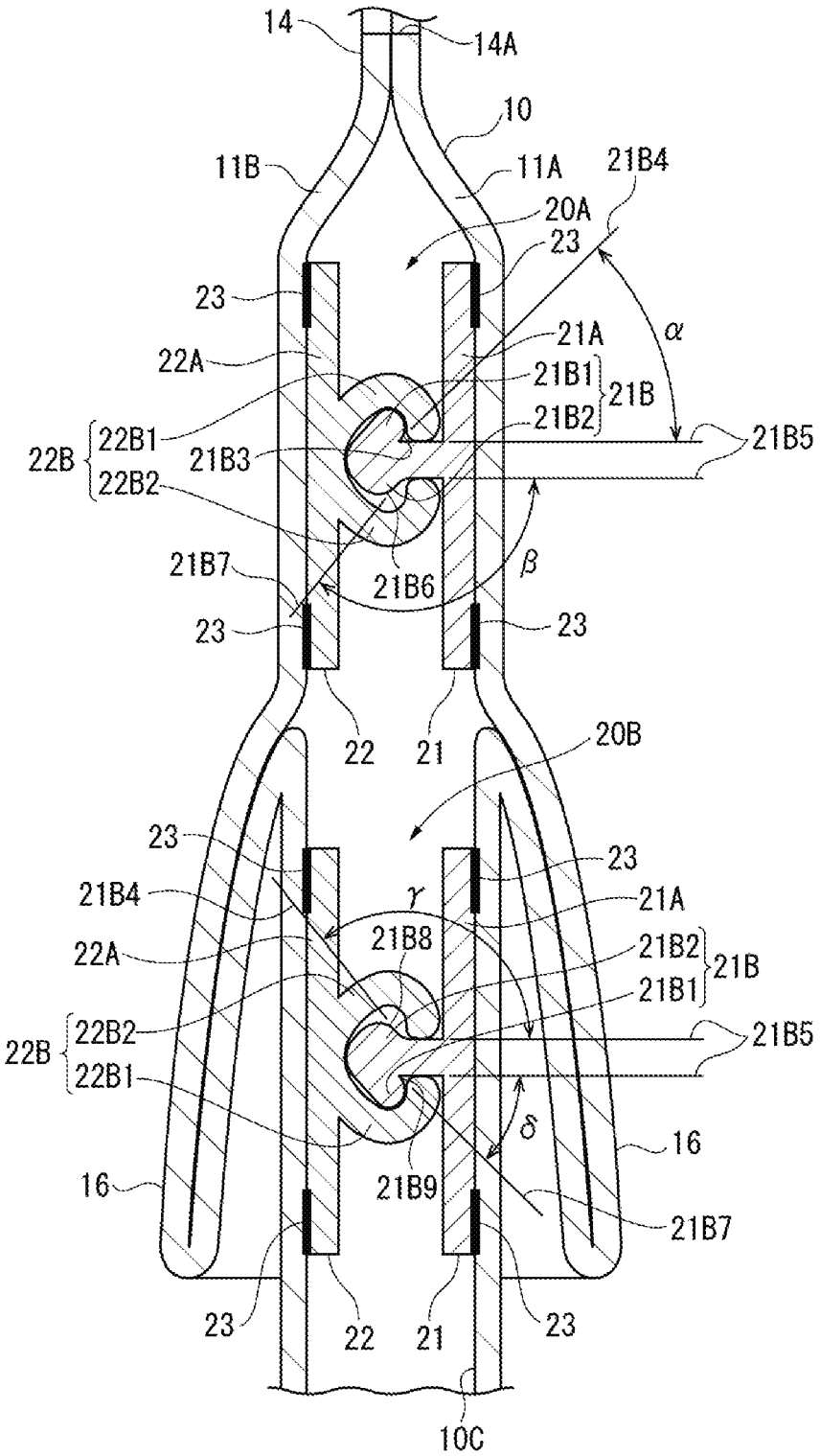
FIG. 22 is a cross sectional view of a relevant part of a zipper-tape bag according to still further another exemplary embodiment of the invention.

In the fourth exemplary embodiment using the plurality of zipper tapes 20, for instance, as shown in FIG. 22, the first zipper tape 20A, which is located closer to the opening 18 than the tabs 16, may have the same claw shape as in the second exemplary embodiment, and the second zipper tape 20B, which is located closer to the housing space 10C than the tabs 16, may have the claw shape reverse to the claw shape of the zipper tape 20A.

Specifically, in the first zipper tape 20A, the first male claw 21B1 has the opening-side slant 21B3 facing the male belt-shaped base 21A. The opening-side slant 21B3 has the hook-shaped cross section, where the angle $\alpha$ between the tangent line 21B4 from the opening-side slant 21B3 and the perpendicular line 21B5 from the male belt-shaped base 21A is smaller than 90 degrees.

Further, the second male claw 21B2 has the housing-side slant 21B6 facing the male belt-shaped base 21A. The housing-side slant 21B6 has the bulge-shaped cross section, where the angle $\beta$ between the tangent line 21B7 from the housing-side slant 21B6 and the perpendicular line 21B5 from the male belt-shaped base 21A is larger than 90 degrees.

In contrast, in the second zipper tape 20B, the first male claw 21B1 has an opening-side slant 21B8 facing the male belt-shaped base 21A. The opening-side slant 21B8 has a bulge-shaped cross section, where an angle $\gamma$ between the tangent line 21B4 from the opening-side slant 21B8 and the perpendicular line 21B5 from the male belt-shaped base 21A is larger than 90 degrees.

Further, the second male claw 21B2 has the housing-side slant 21B9 facing the male belt-shaped base 21A. The housing-side slant 21B9 has the hook-shaped cross section, where an angle $\delta$ between the tangent line 21B7 from the housing-side slant 21B9 and the perpendicular line 21B5 from the male belt-shaped base 21A is smaller than 90 degrees.

Incidentally, each of the opening-side slants 21B3, 21B8 may be a flat surface or a curved surface, and the tangent line 21B4 means a tangent line from the flat surface in the former case or a tangent line passing through the inflection point S of the curved surface in the latter case. The same is applied to the tangent line 21B7.

In the exemplary embodiment shown in FIG. 22, to unseal the bag by holding an edge of the opening 18 having been formed by cutting off the top seal 14, a larger disengaging force is necessary to disengage the male portion 21B and the female portion 22B of the first zipper tape 20A as in the second exemplary embodiment, which results in reducing unintentional unsealing.

Further, when the tabs 16 are pulled to unseal the bag, the respective second ends of the male belt-shaped base 21A and the female belt-shaped base 22A of the first zipper tape 20A in their width directions (the ends near the housing space 10C) are moved in the mutually separating directions, thereby facilitating the disengagement. In contrast, in the second zipper tape 20B having the reversed claw shape, the respective first ends of the male belt-shaped base 21A and the female belt-shaped base 22A (the ends near the opening 18) opposite to the second ends near the housing space 10C in their width directions are moved in the mutually separating directions, facilitating the disengagement. Thus, the bag can be easily unsealed by pulling the tabs 16.

If an inner pressure of the housing space 10C increases, the respective second ends of the male belt-shaped base 21A and the female belt-shaped base 22A of the second zipper tape 20B in their width directions (the ends near the housing space 10C) would be moved in the mutually separating directions, thereby requiring a larger disengaging force for disengaging the male portion 21B and the female portion 22B and, consequently, preventing unintentional disengagement. Problems such as leakage of the content can thus be prevented.

Figure 23:
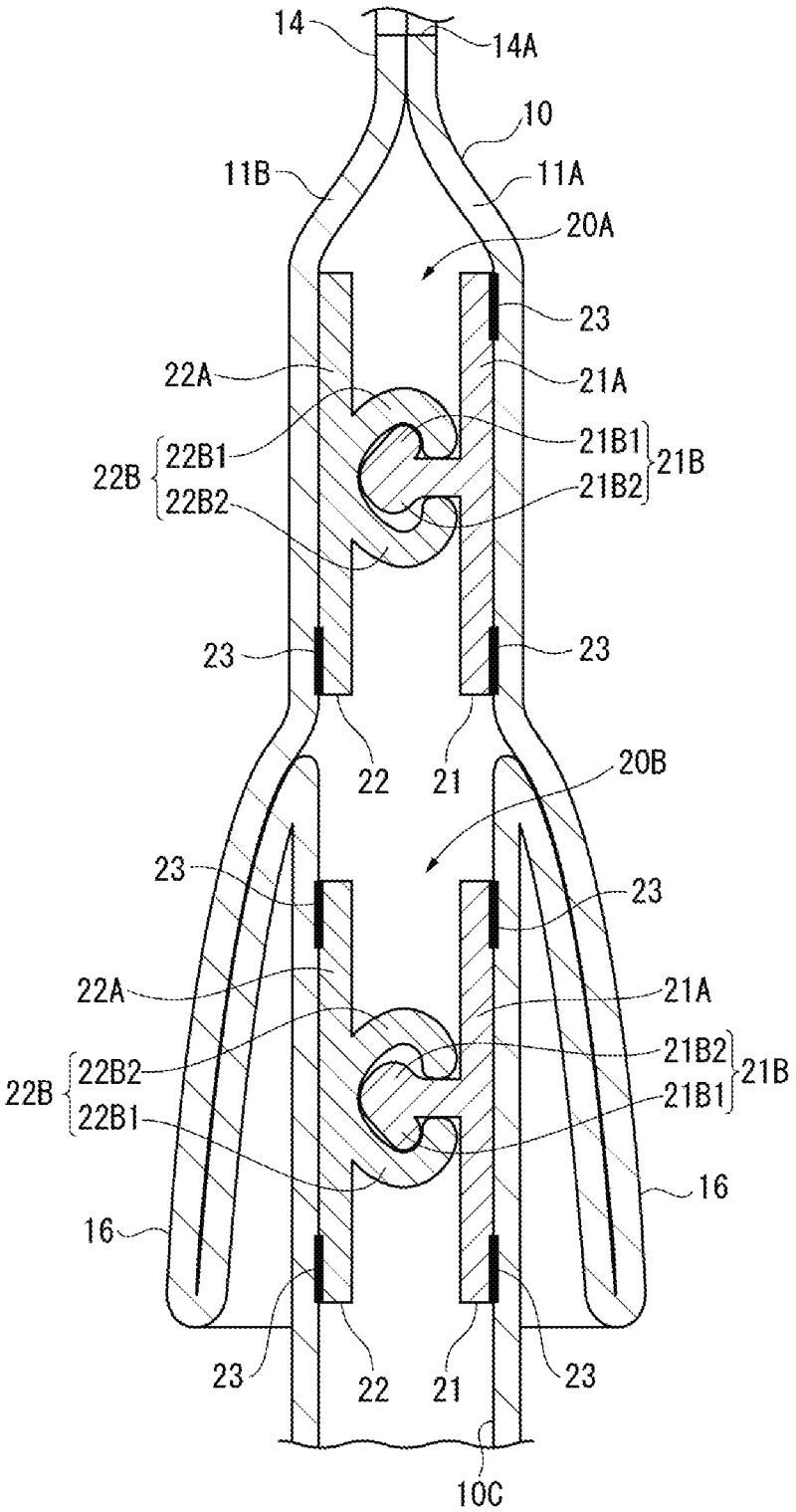
FIG. 23 is a cross sectional view of a relevant part of a zipper-tape bag according to still further another exemplary embodiment of the invention.

Further, in the fourth exemplary embodiment, the zipper tape 20A may be one-side-released as in the third exemplary embodiment, for instance, as shown in FIG. 23.

The arrangement shown in FIG. 23 also requires a larger disengaging force for disengaging the male portion 21B and the female portion 22B in unsealing the bag from near the opening 18 and, on the other hand, allows for easy disengagement in unsealing the bag by pulling the tabs 16 in the same manner as in the exemplary embodiment shown in FIG. 22. Thus, the male portion 21B and the female portion 22B can be prevented from being unintentionally disengaged due to an increased inner pressure. Especially, combination of the claw shape applied to the first zipper tape 20A and the one-side-release technique requires a larger pulling force for disengagement from near the opening 18 and is thus effective in preventing unintentional unsealing.

Figure 24:
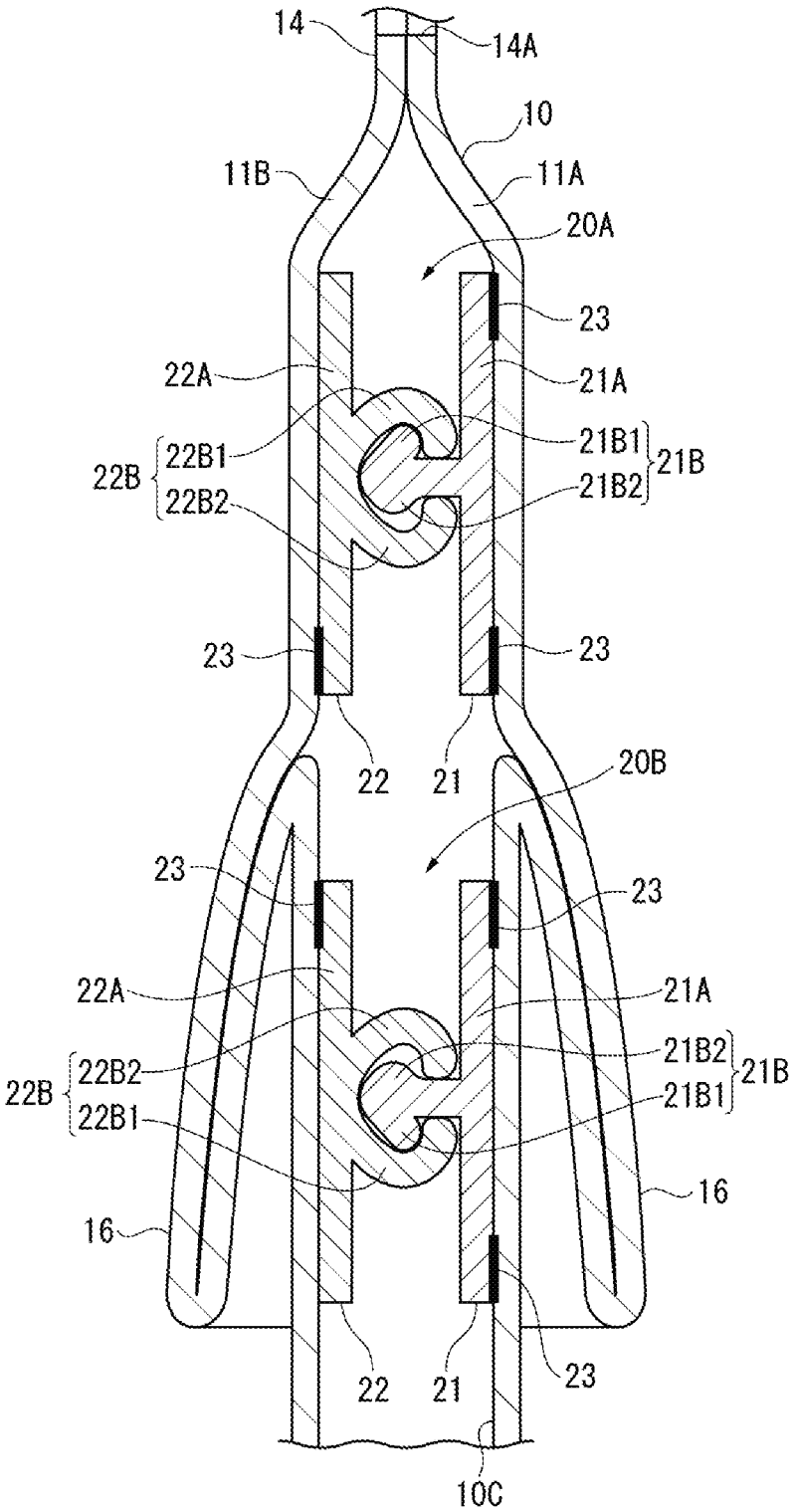
FIG. 24 is a cross sectional view of a relevant part of a zipper-tape bag according to another exemplary embodiment of the invention.

Further, in the fourth exemplary embodiment, the second zipper tape 20B may also be one-side-released as shown in FIG. 24.

The arrangement shown in FIG. 24 also requires a larger disengaging force for disengaging the male portion 21B and the female portion 22B in unsealing the bag from near the opening 18, and allows for easy disengagement in opening the bag by pulling the tabs 16 in the same manner as in the exemplary embodiment shown in FIG. 22. Thus, the male portion 21B and the female portion 22B can be prevented from being unintentionally disengaged due to an increased inner pressure. Especially, combination of the claw shape applied to the second zipper tape 20B and the one-side-release technique requires a larger pulling force for disengagement even if a disengaging force is applied due to an increase in the inner pressure, and is thus further effective in preventing leakage due to the increase in the inner pressure.

In the fourth exemplary embodiment, the male member 21 is bonded to the base film 11A and the female member 22 to the base film 11B, but the female member 22 may be bonded to the base film 11A and the base film 11B to the male member 21 or, alternatively, the male member 21 and the female member 22 may be bonded to each of the base film 11A, 11B.

The male belt-shaped base 21A may include the thickened area 21A1 defined from the base end of the neck area 21BA toward the position of the corresponding one of the tabs 16, and the thinned area 21A2 adjacent to the thickened area 21A1 in other exemplary embodiments, such as the second exemplary embodiment and the exemplary embodiment shown in FIG. 18, in the same manner as in the fifth exemplary embodiment. Especially, this arrangement is beneficial to the second exemplary embodiment and the exemplary embodiments shown in FIGS. 23, 24, where one end of the female belt-shaped base 22A in the width direction is not sealed to the bag body 10, or "one-side-released."

Figure 25:
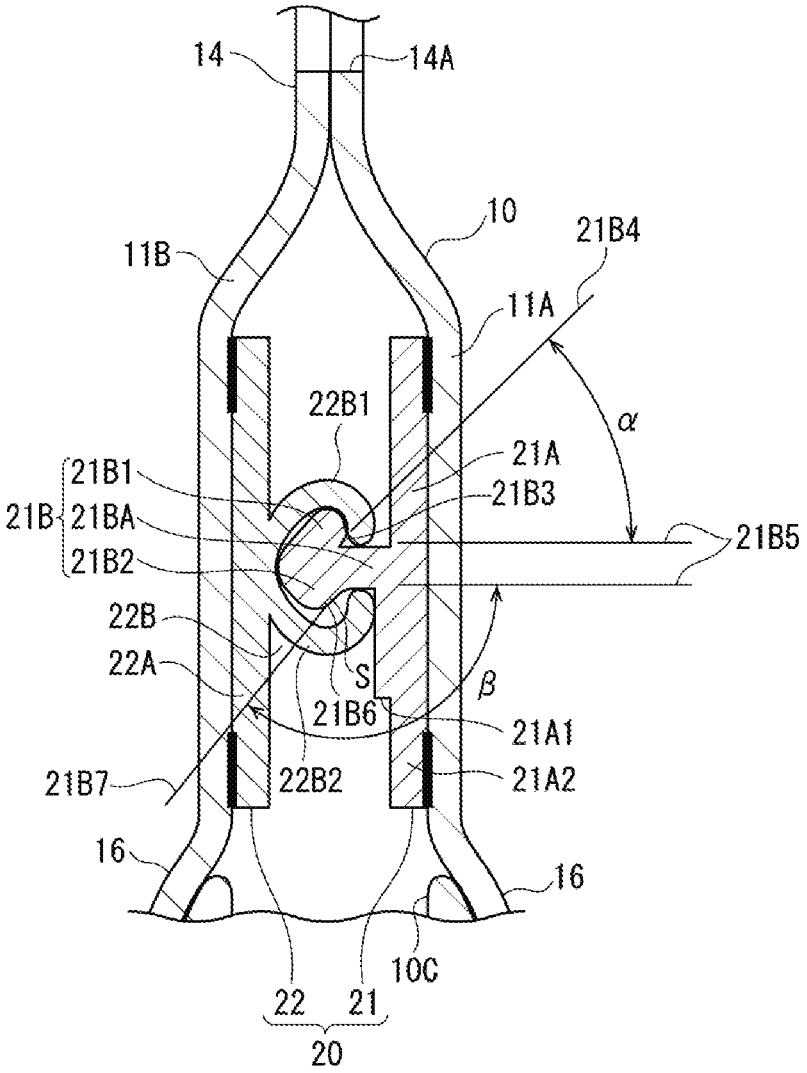
FIG. 25 is a cross sectional view of a relevant part of a zipper-tape bag according to still further another exemplary embodiment of the invention.
Figure 26:
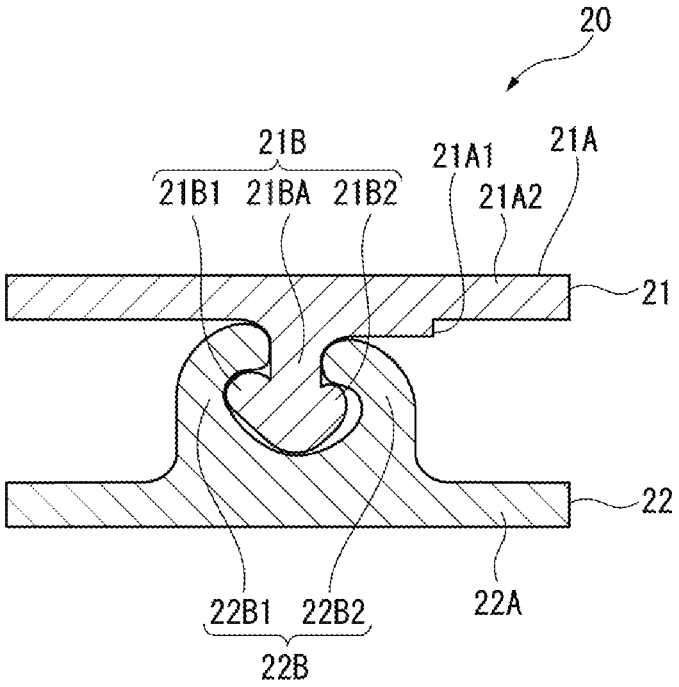
FIG. 26 is a cross sectional view of a zipper tape according to another exemplary embodiment of the invention.
Figure 27:
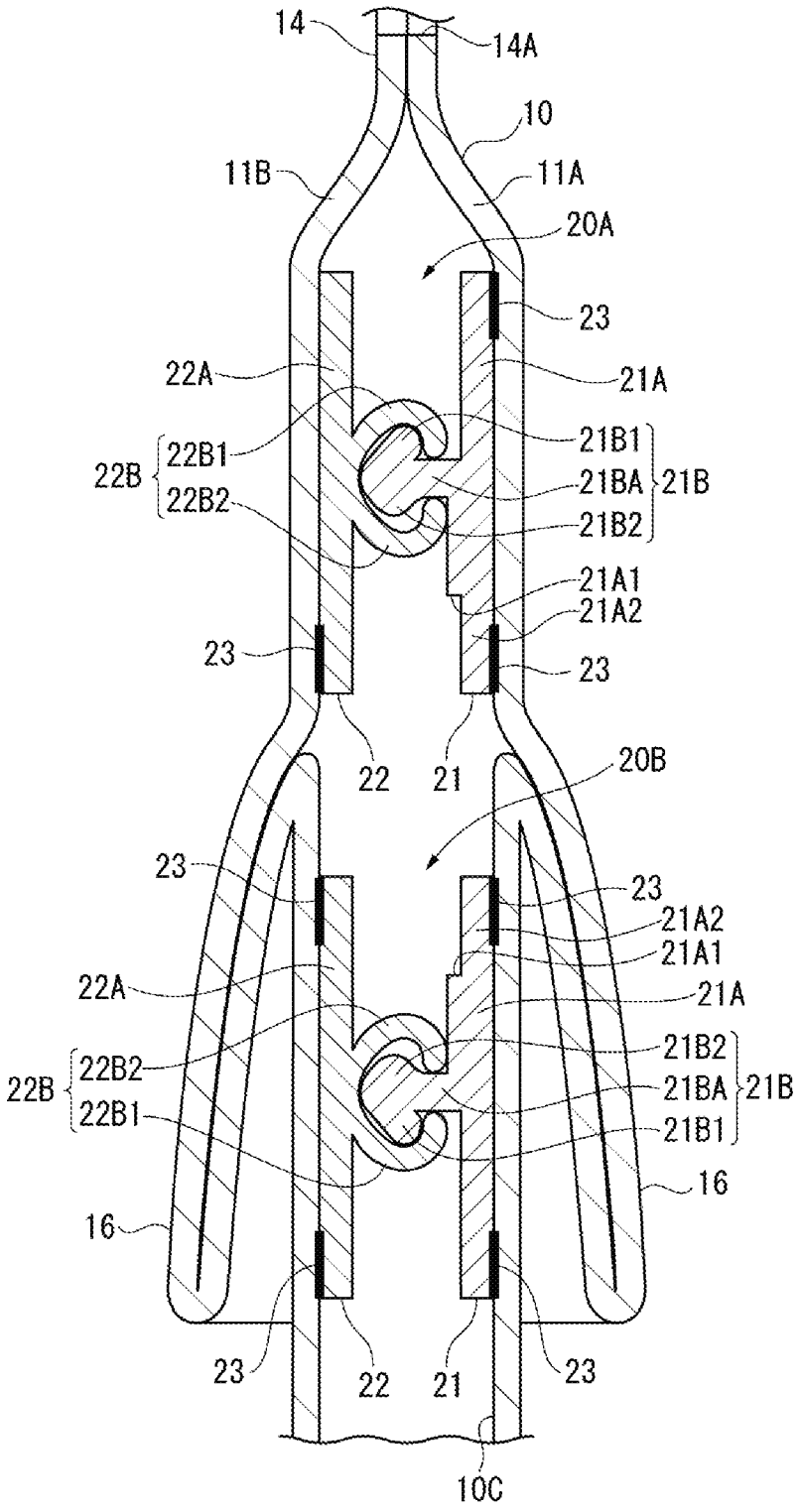
FIG. 27 is a cross sectional view of a relevant part of a zipper-tape bag according to still further another exemplary embodiment of the invention.
Figure 28:
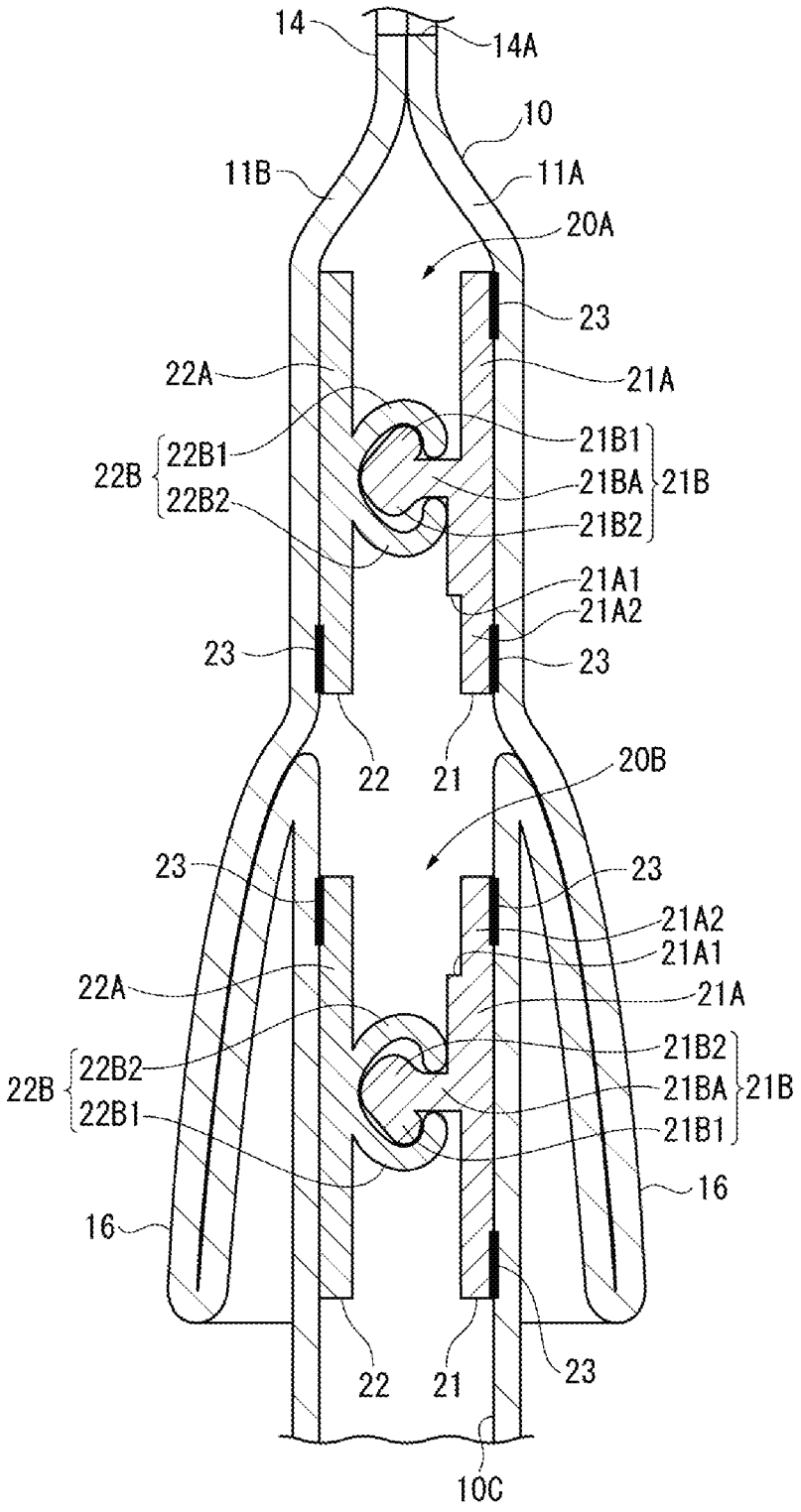
FIG. 28 is a cross sectional view of a relevant part of a zipper-tape bag according to still further another exemplary embodiment of the invention.

For instance, the second exemplary embodiment may be modified to an exemplary embodiment shown in FIG. 25, the exemplary embodiment shown in FIG. 18 to an exemplary embodiment shown in FIG. 26, the exemplary embodiment shown in FIG. 23 to an exemplary embodiment shown in FIG. 27, and the exemplary embodiment shown in FIG. 24 to an exemplary embodiment shown in FIG. 28. In these exemplary embodiments, the male belt-shaped base 21A is greatly bent around the boundary between the thickened area 21A1 and the thinned area 21A2 as the bag is being unsealed by holding the tabs 16 in the same manner as in the fifth exemplary embodiment. This allows the second male claw 21B2 and the second female claw 22B2 to move in the separating direction, facilitating the disengagement and, consequently, enabling easy unsealing.

The invention is applicable to a gusset bag having the lateral portions 10A and the bottom portion 10B and may also be applicable to a gusset bag having only the bottom portion 10B and a gusset bag without the bottom portion 10B, and further to a bag having none of the lateral portion 10A and the bottom portion 10B.

The process for manufacturing the zipper-tape bag 1 is not necessarily the three-sided bag-making process, but may alternatively be a four-sided bag-making process, a pillow-bag making process, rotary-drum bag-making process or the like.

The invention claimed is:

1. A zipper-tape bag comprising:

a bag body defining a housing space for containing a content;

a zipper tape provided to an inside of the bag body, the inside of the bag body defining a first inner surface and a second inner surface facing the first surface, the zipper tape comprising:

a first member comprising a first belt-shaped base bonded to the first inner surface of the bag body, and a first engaging portion provided to the first belt-shaped base; and a second member comprising a second belt-shaped base bonded to the second inner surface of the bag body, and a second engaging portion provided to the second belt-shaped base and engageable with the first engaging portion; and a tab provided to an outside of the bag body at a position closer to the housing space than a bonded position of each of the first belt-shaped base and the second belt-shaped base;

wherein one of the first belt-shaped base and the second belt-shaped base is bonded to the bag body only at a portion near the housing space with respect to a position of the first engaging portion or the second engaging portion in the width direction, and one of the first engaging portion and the second engaging portion comprises a neck area projecting from the first belt-shaped base or the second belt-shaped base, and the first belt-shaped base or the second belt-shaped base from which the neck area projects comprises: a thickened area continuous in the width direction from a base end of the neck area, which projects from the first belt-shaped base or the second belt-shaped base, toward the tab; and a thinned area adjacent to the thickened area and thinner than the thickened area.

2. The zipper-tape bag according to claim 1, wherein the first belt-shaped base and the second belt-shaped base each have opposite first and second ends in a width direction, the second end being located near the housing space with respect to the first end, and the zipper tape requires a larger disengaging force for disengaging the first engaging portion and the second engaging portion when portions of the first and second inner surfaces of the bag body respectively opposing the first ends of the first belt-shaped base and the second belt-shaped base are moved in mutually separating directions with the first engaging portion and the second engaging portion being engaged than when portions of the first and second inner surfaces of the bag body respectively opposing the second ends of the first belt-shaped base and the second belt-shaped base are moved in the mutually separating directions.

3. The zipper-tape bag according to claim 2, wherein the first engaging portion comprises a first locking claw projecting opposite the housing space, and a second locking claw projecting opposite the first locking claw, the second engaging portion comprises a first engaging claw engageable with the first locking claw, and a second engaging claw engageable with the second locking claw, the first locking claw has a first slant facing the first belt-shaped base, an angle θ between a tangent line from the first slant and a perpendicular line from the first belt-shaped base being smaller than 90 degrees, and the second locking claw has a second slant facing the first belt-shaped base, an angle θ between a tangent line from the second slant and the perpendicular line from the first belt-shaped base being larger than 90 degrees.

4. A zipper-tape bag comprising:

a bag body defining a sole housing space for containing a content;

a first zipper tape provided to an inside of the bag body, the inside of the bag body defining a first inner surface and a second inner surface facing the first inner surface;

a second zipper tape provided to the inside of the bag body in parallel with the first zipper tape, the second zipper tape being closer to the housing space than the first zipper tape, the first and second zipper tapes each comprising:

a first member comprising a first belt-shaped base bonded to the first inner surface of the bag body, and a first engaging portion provided to the first belt-shaped base; and a second member comprising a second belt-shaped base bonded to the second inner surface of the bag body, and a second engaging portion provided to the second belt-shaped base and engageable with the first engaging portion; and a tab provided to an outside of the bag body at a position between the first zipper tape and the second zipper tape, wherein the first zipper tape is arranged closer to an opening of the bag body than the tab, and the second zipper tape is arranged closer to the housing space than the tab, at least one of the first belt-shaped base and the second belt-shaped base of the second zipper tape is bonded to the bag body at a position being closer to the housing space with respect to a position of the first engaging portion or the second engaging portion in a width direction of the second zipper tape wherein one of the first belt-shaped base and the second belt-shaped base of the second zipper tape is bonded to the bag body only at a portion opposite the housing space with respect to a position of the first engaging portion or the second engaging portion in the width direction.

5. The zipper-tape bag according to claim 4, wherein the first belt-shaped base and the second belt-shaped base of each of the first and second zipper tapes each have opposite first and second ends in a width direction, the second end being located near the housing space with respect to the first end, the first zipper tape requires a larger disengaging force for disengaging the first engaging portion and the second engaging portion when portions of the first and second inner surfaces of the bag body respectively opposing the first ends of the first belt-shaped base and the second belt-shaped base are moved in mutually separating directions with the first engaging portion and the second engaging portion being engaged than when portions of the first and second inner surfaces of the bag body respectively opposing the second ends of the first belt-shaped base and the second belt-shaped base are moved in the mutually separating directions, and the second zipper tape requires a smaller disengaging force for disengaging the first engaging portion and the second engaging portion when portions of the first and second inner surfaces of the bag body respectively opposing the first ends of the first belt-shaped base and the second belt-shaped base are moved in mutually separating directions with the first engaging portion and the second engaging portion being engaged than when portions of the first and second inner surfaces of the bag body respectively opposing the second ends of the first belt-shaped base and the second belt-shaped base are moved in the mutually separating directions.

6. The zipper-tape bag according to claim 4, wherein the first engaging portion of each of the first and second zipper tapes comprises a first locking claw projecting opposite the housing space, and a second locking claw projecting opposite the first locking claw, the second engaging portion comprises a first engaging claw engageable with the first locking claw, and a second engaging claw engageable with the second locking claw, the first locking claw of the first zipper tape has a first slant facing the first belt-shaped base of the first zipper tape, an angle θ between a tangent line from the first slant and a perpendicular line from the first belt-shaped base of the first zipper tape being smaller than 90 degrees, the second locking claw of the first zipper tape has a second slant facing the first belt-shaped base of the first zipper tape, an angle θ between a tangent line from the second slant and the perpendicular line from the first belt-shaped base of the first zipper tape being larger than 90 degrees, the first locking claw of the second zipper tape has a third slant facing the first belt-shaped base of the second zipper tape, an angle θ between a tangent line from the third slant and a perpendicular line from the first belt-shaped base of the second zipper tape being larger than 90 degrees, and the second locking claw of the second zipper tape has a fourth slant facing the first belt-shaped base of the second zipper tape, an angle θ between a tangent line from the fourth slant and the perpendicular line from the first belt-shaped base of the second zipper tape being smaller than 90 degrees.

7. A zipper-tape bag comprising:

a bag body defining a sole housing space for containing a content;

a first zipper tape provided to an inside of the bag body, the inside of the bag body defining a first inner surface and a second inner surface facing the first inner surface;

a second zipper tape provided to the inside of the bag body in parallel with the first zipper tape, the second zipper tape being closer to the housing space than the first zipper tape, the first and second zipper tapes each comprising:

a first member comprising a first belt-shaped base bonded to the first inner surface of the bag body, and a first engaging portion provided to the first belt-shaped base; and a second member comprising a second belt-shaped base bonded to the second inner surface of the bag body, and a second engaging portion provided to the second belt-shaped base and engageable with the first engaging portion; and a tab provided to an outside of the bag body at a position between the first zipper tape and the second zipper tape, wherein the first zipper tape is arranged closer to an opening of the bag body than the tab, and the second zipper tape is arranged closer to the housing space than the tab, at least one of the first belt-shaped base and the second belt-shaped base of the second zipper tape is bonded the bag body at a position being closer to the housing space with respect to a position of the first engaging portion or the second engaging portion in a width direction of the second zipper tape wherein one of the first belt-shaped base and the second belt-shaped base of the first zipper tape is bonded to the bag body only at a portion near the housing space with respect to a position of the first engaging portion or the second engaging portion in the width direction.

8. The zipper-tape bag according to claim 7, wherein the first belt-shaped base and the second belt-shaped base of each of the first and second zipper tapes each have opposite first and second ends in a width direction, the second end being located near the housing space with respect to the first end, the first zipper tape requires a larger disengaging force for disengaging the first engaging portion and the second engaging portion when portions of the first and second inner surfaces of the bag body respectively opposing the first ends of the first belt-shaped base and the second belt-shaped base are moved in mutually separating directions with the first engaging portion and the second engaging portion being engaged than when portions of the first and second inner surfaces of the bag body respectively opposing the second ends of the first belt-shaped base and the second belt-shaped base are moved in the mutually separating directions, and the second zipper tape requires a smaller disengaging force for disengaging the first engaging portion and the second engaging portion when portions of the first and second inner surfaces of the bag body respectively opposing the first ends of the first belt-shaped base and the second belt-shaped base are moved in mutually separating directions with the first engaging portion and the second engaging portion being engaged than when portions of the first and second inner surfaces of the bag body respectively opposing the second ends of the first belt-shaped base and the second belt-shaped base are moved in the mutually separating directions.

9. The zipper-tape bag according to claim 7, wherein the first engaging portion of each of the first and second zipper tapes comprises a first locking claw projecting opposite the housing space, and a second locking claw projecting opposite the first locking claw, the second engaging portion comprises a first engaging claw engageable with the first locking claw, and a second engaging claw engageable with the second locking claw, the first locking claw of the first zipper tape has a first slant facing the first belt-shaped base of the first zipper tape, an angle θ between a tangent line from the first slant and a perpendicular line from the first belt-shaped base of the first zipper tape being smaller than 90 degrees, the second locking claw of the first zipper tape has a second slant facing the first belt-shaped base of the first zipper tape, an angle θ between a tangent line from the second slant and the perpendicular line from the first belt-shaped base of the first zipper tape being larger than 90 degrees, the first locking claw of the second zipper tape has a third slant facing the first belt-shaped base of the second zipper tape, an angle θ between a tangent line from the third slant and a perpendicular line from the first belt-shaped base of the second zipper tape being larger than 90 degrees, and the second locking claw of the second zipper tape has a fourth slant facing the first belt-shaped base of the second zipper tape, an angle θ between a tangent line from the fourth slant and the perpendicular line from the first belt-shaped base of the second zipper tape being smaller than 90 degrees.

10. The zipper-tape bag according to claim 4, wherein one of the first engaging portion and the second engaging portion comprises a neck area projecting from the first belt-shaped base or the second belt-shaped base, and the first belt-shaped base or the second belt-shaped base from which the neck area projects comprises: a thickened area continuous in the width direction from a base end of the neck area, which projects from the first belt-shaped base or the second belt-shaped base, toward the tab; and a thinned area adjacent to the thickened area and thinner than the thickened area.

* * * * *